US008849143B2

(12) United States Patent
Haga

(10) Patent No.: US 8,849,143 B2
(45) Date of Patent: Sep. 30, 2014

(54) IMAGE FORMING APPARATUS WITH BACKUP CONTROL

(75) Inventor: Tatsuyoshi Haga, Hochioji (JP)

(73) Assignee: Konica Minolta Business Techologies, Inc. (JP)

( * ) Notice: Subject to any disclaimer, the term of this patent is extended or adjusted under 35 U.S.C. 154(b) by 396 days.

(21) Appl. No.: 13/069,877

(22) Filed: Mar. 23, 2011

(65) Prior Publication Data

US 2011/0236049 A1 Sep. 29, 2011

(30) Foreign Application Priority Data

Mar. 23, 2010 (JP) ..... 2010-065590

(51) Int. Cl.
*G03G 15/00* (2006.01)

(52) U.S. Cl.
CPC .. *G03G 15/5004* (2013.01); *G03G 2215/00092* (2013.01); *G03G 2221/16* (2013.01)
USPC ..... 399/75

(58) Field of Classification Search
USPC ..... 399/75
See application file for complete search history.

(56) References Cited

FOREIGN PATENT DOCUMENTS

| | | | |
|---|---|---|---|
| JP | 2001195315 A | * | 7/2001 |
| JP | 2006-262048 A | | 9/2006 |
| JP | 2007004229 A | * | 1/2007 |
| JP | 2010167665 A | * | 8/2010 |

OTHER PUBLICATIONS

Computer translation of JP2010-167665A to Miura, Aug. 2010.*
Computer translation of jp2006-262048a; cited by applicant; publication date Sep. 28, 2006 to Tanaka computer translation of jp2007-004229a; publication date Jan. 11, 2007 to Tanaka.*
Notification of Reasons for Refusal for Japanese Application No. 2010-065590; Date of Mailing: Aug. 20, 2013, with English Translation.

* cited by examiner

*Primary Examiner* — Quana M Grainger
(74) *Attorney, Agent, or Firm* — Cantor Colburn LLP

(57) ABSTRACT

An image forming apparatus including: a memory unit to store various pieces of information; and a control unit to execute backup control to store information stored in the memory unit into an external memory device and to make the image forming apparatus shift from an operating state to a predetermined standby state, wherein with the backup control, the control unit makes the image forming apparatus shift from the operating state to the standby state.

11 Claims, 21 Drawing Sheets

FIG.3

| UNIT | NORMAL MODE | POWER SAVING MODE | | |
|---|---|---|---|---|
| | | NORMAL POWER SAVING MODE (MODE 1) | BACKUP POWER SAVING MODE (MODE 2) | BACKUP WAKE MODE (MODE 3) |
| IMAGE FORMING UNIT | ON | OFF | OFF | OFF |
| OPERATION DISPLAY UNIT | ON | OFF | OFF | ON |
| HDD | ON | OFF | ON | ON |
| CPU | ON | SYSTEM RESET | ON | ON |

IMAGE FORMING APPARATUS WITH BACKUP CONTROL

BACKGROUND OF THE INVENTION

1. Field of the Invention

The present invention relates to an image forming apparatus.

2. Description of Related Art

When a conventional image forming apparatus is newly installed, or when the image forming apparatus is recovered after an abnormal operation occurs, recorded information stored in a nonvolatile memory in the image forming apparatus is transferred to an external memory device and backed up in order to restore the settings (for example, a registration value, a counter value of the number of prints, and the like) of the image forming apparatus to the original state.

While the information is being backed up, it is necessary to regulate an image forming operation by an image forming unit because the backup operation influences readout of data from the nonvolatile memory and hinders the image forming operation. However, in the conventional image forming apparatus, although the operation is regulated, how to supply an electric power to the apparatus efficiently is not considered at all. For this reason, the electric power is wasted.

In consideration of the above issue, a conventional image forming apparatus which is configured so that a backup operation is performed when the image forming apparatus shifts to a standby state is disclosed in Japanese Patent Application Laid-Open No. 2006-262048. According to this document, since a backup operation is executed when the image forming apparatus shifts to a standby state in which power consumption is suppressed, power consumption can be suppressed.

However, in the technique described in Japanese Patent Application Laid-Open No. 2006-262048 mentioned above, it is necessary to wait until the state is shifted to the standby state in order to execute the backup operation, and, during this time, power is excessively consumed.

SUMMARY OF THE INVENTION

It is, therefore, a main object of the present invention to provide an image forming apparatus which enables reduction of power consumption in executing backup operation.

To solve at least the abovementioned object, an image forming apparatus reflecting one aspect of the present invention includes: a memory unit to store various pieces of information; and a control unit to execute backup control to store information stored in the memory unit into an external memory device and to make the image forming apparatus shift from an operating state to a predetermined standby state, wherein, with the backup control, the control unit makes the image forming apparatus shift from the operating state to the standby state.

An image forming apparatus reflecting another aspect of the present invention includes: a memory unit to store various pieces of information; a plurality of units each of which operates or stops operating depending on a state of the image forming apparatus; and a control unit to execute backup control to store information stored in the memory unit into an external memory device and to make the image forming apparatus shift from an operating state to a predetermined standby state in which the plurality of units are made to stop operating, wherein, when a predetermined recovering condition is satisfied in the standby state, the control unit determines whether the backup control is being executed and makes a unit, which corresponds to a determination result, operate again among the plurality of units which are non-operating.

An image forming apparatus reflecting another aspect of the present invention includes: a memory unit to store various pieces of information; a plurality of units each of which operates or stops operating depending on a state of the image forming apparatus; and a control unit to execute backup control to store information stored in the memory unit into an external memory device and, when a predetermined standby state shift condition is satisfied, to determine whether the backup control is being executed and to make a unit, which corresponds to a determination result, stop operating among the plurality of units which are operating.

An image forming apparatus reflecting another aspect of the present invention includes: a memory unit to store various pieces of information; and a control unit to execute backup control to store information stored in the memory unit into an external memory device and, when a predetermined standby state shift condition is satisfied, to make the image forming apparatus shift to a predetermined standby state in which a unit, which is operating, is made to stop operating, wherein the standby state includes a first standby state in which a unit, except for at least the memory unit, is non-operating, and a second standby state in which a unit including the memory unit is non-operating.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 3 is a diagram explaining a relationship between a mode representing a state of the image forming apparatus and an operating state of each unit;

DESCRIPTION OF THE PREFERRED EMBODIMENTS

An embodiment of the present invention is described below with reference to the drawings. The scope of the invention is not limited to illustrative examples.

Figure 1:
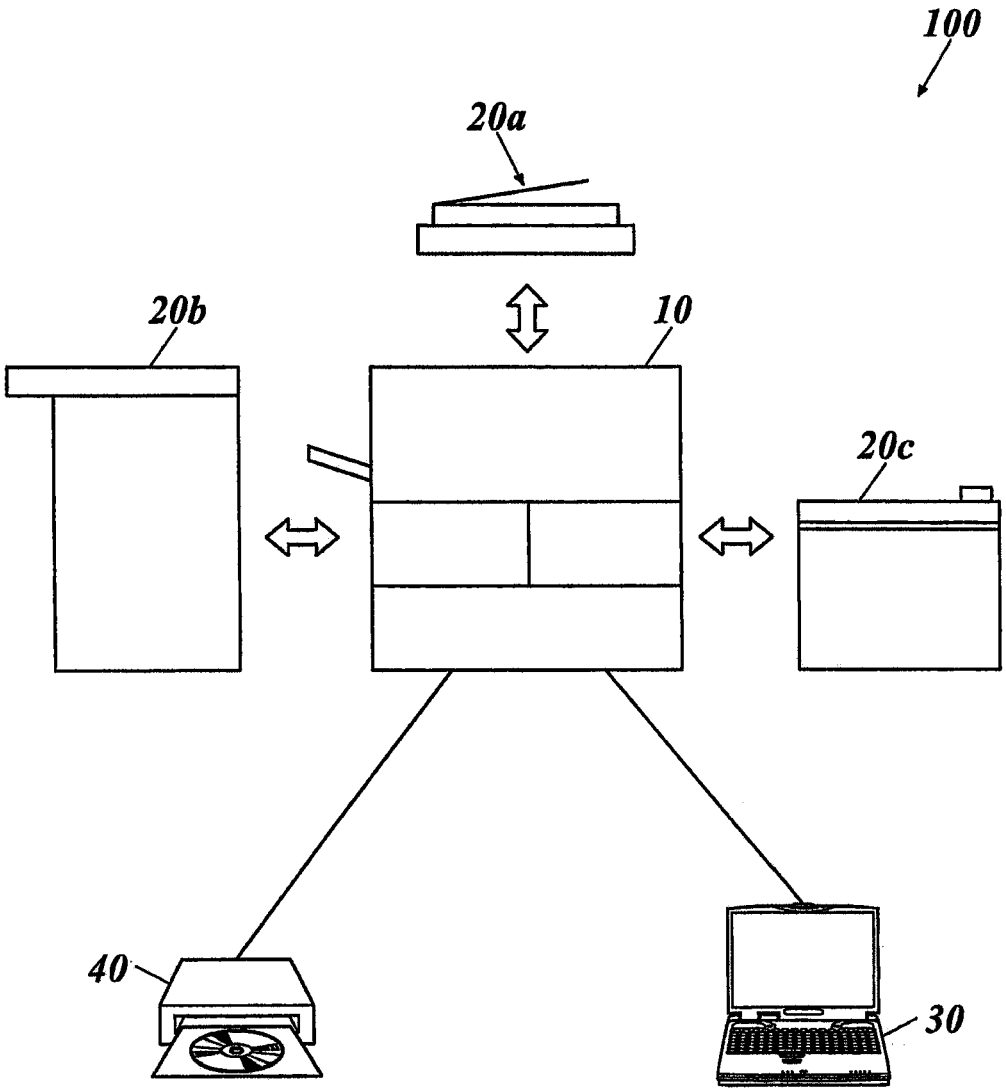
FIG. 1 is a diagram illustrating a system configuration of a maintenance system according to an embodiment of the present invention.

A maintenance system 100 in the embodiment includes, as illustrated in FIG. 1, for example, an image forming apparatus 10, a PC (Personal Computer) 30, an external memory device 40, and the like. The maintenance system 100 is a system which executes maintenance of the image forming apparatus 10 by using the PC 30 or the external memory device 40. The PC 30 can be connected to the image forming apparatus 10 through a network, and the external memory device 40 can be connected to the image forming apparatus 10 using a USB (Universal Serial Bus) or the like.

The image forming apparatus 10 performs image processing to an input image to generate an output image and print out the output image. In the image forming apparatus 10, various optional devices (to be generally referred to as optional devices 20*a* to 20*c* hereinafter), such as an ADF (Auto Document Feeder) 20*a*, a finisher 20*b*, and a paper feed unit 20*c*, can be connected, and the optional devices 20*a* to 20*c* can be added or removed as usage.

Figure 2:
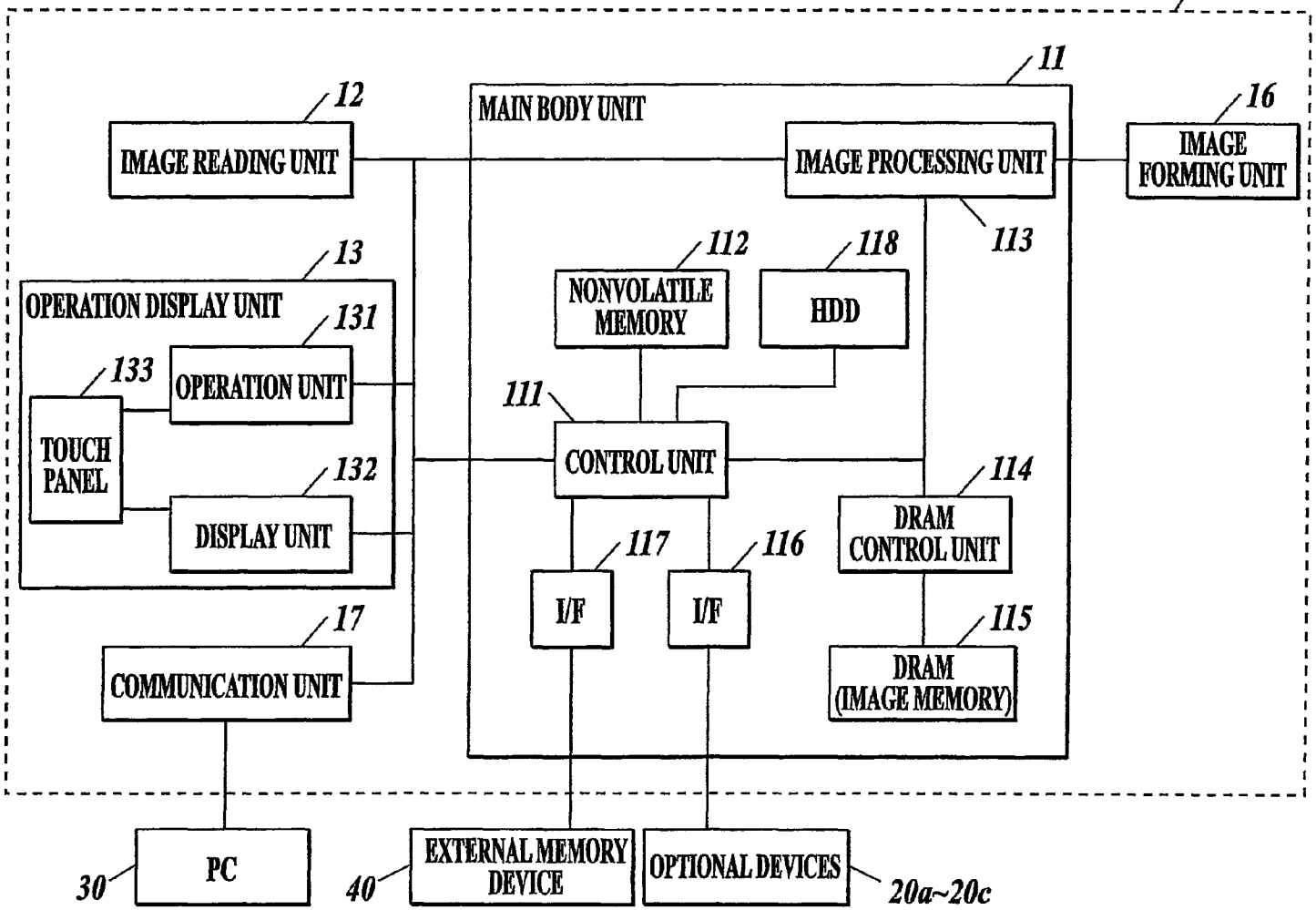
FIG. 2 is a diagram illustrating an internal configuration of an image forming apparatus according to an embodiment of the present invention.

The image forming apparatus 10, as illustrated in FIG. 2, includes a main body unit 11, an image reading unit 12, an operation display unit 13, an image forming unit 16, and a communication unit 17.

The main body unit 11 includes a control unit 111, a nonvolatile memory 112, an image processing unit 113, a DRAM (Dynamic Random Access Memory) control unit 114, a DRAM 115, I/Fs (Interfaces) 116 and 117, and an HDD 118 (Hard Disk Drive).

The control unit 111 includes a CPU (Central Processing Unit), a RAM (Random Access Memory), and the like. The control unit 111 reads control programs stored in the nonvolatile memory 112, develops the control programs in the RAM, centrally controls operations of each unit in cooperation with the control programs, or executes various arithmetic operations.

The nonvolatile memory 112 is an internal memory unit to store the control programs or parameters required to execute the programs. A ROM (Read Only Memory) or the like can be used as the nonvolatile memory 112. The nonvolatile memory 112 stores setting information related to various settings of the image forming apparatus 10. For example, the nonvolatile memory 112 stores main body unique information, basic information, adjustment information, optional configuration information, and the like.

The image processing unit 113 performs various kinds of image processing to a read image input from the image reading unit 12 to generate an output image to be output. The image processing includes a color conversion process, an averaging process, a gamma correction process, a resolution conversion process, a screen process, and the like. The generated output image is output to the DRAM control unit 114.

The DRAM control unit 114 controls an input/output operation of an output image stored in the DRAM 115.

The DRAM 115 is an image memory to store the output image.

The I/F 116 is an interface to exchange control information or the like between the optional devices 20*a* to 20*c* and the control unit 111.

The I/F 117 is an interface to exchange (read or write) data stored in the external memory device 40.

An HDD 118 as an example of a memory unit is a nonvolatile memory to store job data of a remaining job which remains to be executed. The job data includes data of a copy job to form an image based on the output image read by the image reading unit 12, a scan job to convert a format into a document file format such as a PDF (Portable Document Format) based on the output image read by the image reading unit 12, a print job to form an image based on a page description language such as a PDL (Page Description Language) to be transmitted from a host apparatus such as the PC 30, and the like. The HDD 118 also stores image forming data generated to execute the copy job, the print job or the like.

The memory unit is not limited to the HDD 118, but any storage medium can be used as long as it is a nonvolatile memory etc. which can hold memory information even when a power supply is interrupted.

The image reading unit 12 includes a light source, a CCD (Charge Coupled Device), an A/D converter, and the like. The image reading unit 12 focuses reflected light of the light emitted from the light source to irradiate and scan an original, photoelectrically converts the focused light with the CCD to read an original image, and converts the signal of the read image into digital image data by performing A/D conversion using the A/D converter. In addition, the image includes not only an image such as a graphic or a photograph but also a character image such as a character or a sign, and the like. When the ADP 20*a* is connected to the image forming apparatus 10, an original is automatically conveyed to the image reading unit 12 by the ADF 20*a* and the conveyed original is read by the image reading unit 12.

The operation display unit 13 includes an operation unit 131, a display unit 132, and a touch panel 133.

The operation unit 131 includes various function keys such as a start key for instructing a start of printing and numeric keys. When the function keys or the touch panel 133 is operated, a corresponding operation signal is output to the control unit 111.

The display unit 132 includes an LCD (Liquid Crystal Display) formed integrally with the touch panel 133 and displays various operation screens to execute a print operation or a backup operation (to be described below) on a display area of the LCD.

The image forming unit 16 forms an image by an electrophotographic system based on an output image input from the image processing unit 113 of the main body unit 11. In the electrophotographic system, a photosensitive drum is irradiated with a laser beam from a laser light source to perform exposure, and an electrostatic latent image is formed. A developing unit sprays toner on the electrostatic latent image to form a toner image, and then the toner image is transferred to a recording sheet. When the paper feed unit 20*c* is connected to the image forming apparatus 10, a recording sheet is fed from the paper feed unit 20*c*. The recording sheet onto which the toner image is transferred is subjected to a fixing process and then is output to an external paper output tray. At this time, when the finisher 20*b* is connected to the image forming apparatus 10, the recording sheet onto which the toner image is transferred is output to the finisher 20*b*.

The communication unit 17 includes a communication interface such as a network interface card to communicate with an external apparatus such as the PC 30 through a network.

The PC 30 includes, for example, a memory device such as an HDD. When the image forming apparatus 10 performs a backup operation, the PC 30 functions as an external memory device to store information stored in the HDD 118.

The external memory device 40 is an external memory device to store information stored in the HDD 118 when the image forming apparatus 10 performs a backup operation. As the external memory device 40, for example, an HDD, a CD-R (Compact Disk-Recordable) drive, a DVD (Digital Versatile Disk) drive, a USB memory, or the like can be used.

An operation of the maintenance system 100 configured as described above is described.

In the embodiment, the image forming apparatus 10 is configured to shift between a normal mode in which the image forming apparatus 10 is operating (an operating state) and a power saving mode in which all or some units are non-operating (a standby state). The power saving mode further includes a plurality of modes. The image forming apparatus 10 executes control to determine a mode to which the image forming apparatus 10 is to shift among the normal mode and the plurality of power saving modes depending on presence or absence of a user operation through the operation unit 131 and the touch panel 133 and depending on whether the image forming apparatus 10 is performing a restore operation or a backup operation.

In the normal mode (the operating state), as illustrated in FIG. 3, all of the image forming unit 16, the operation display unit 13, the HDD 118, and the CPU of the control unit 111 are set in an "ON" state showing that the units are in an operating state. The normal mode, as described below, is a mode to which the image forming apparatus 10 shifts when the backup operation or the restore operation is not being executed and when a predetermined recovering operation is performed by a user using the operation unit 131 or the touch panel 133. "To perform the recovering operation" in the embodiment means "to operate any key on the operation unit 131 and the touch panel 133". However, the recovering operation may be another operation. The recovering operation may be realized by, for example, by pressing a plurality of keys simultaneously, keeping a predetermined key pressed down, or inputting a password, or the like.

In a non-backup-time standby state or a normal power saving mode (to be also referred to as a power saving mode 1 hereinafter) (a second standby state), all of the image forming unit 16, the operation display unit 13, and the HDD 118 are set in an "OFF" state representing a standby state in which a power supply is stopped. After stopping power supplies of peripheral units such as the image forming unit 16 and the operation display unit 13, and the HDD 118, the CPU of the control unit 111 lastly falls into a system reset state, and is on standby such that the image forming apparatus 10 can shift to the operating state by receiving a signal input when the recovering operation described above is executed. The normal power saving mode, as described below, is a mode to which the image forming apparatus 10 shifts when the backup operation or the restore operation is not being executed and when there is no input from a user through the operation unit 131 or the touch panel 133 for a predetermined period of time.

In a backup-time standby state or a backup power saving mode (to be also referred to as a power saving mode 2 hereinafter) (a first standby state), the image forming unit 16 and the operation display unit 13 are set in an "OFF" state, and the HDD 118 and the CPU of the control unit 111 are set in an "ON" state. The backup power saving mode, as described below, is a mode to which the image forming apparatus 10 shifts when the backup operation or the restore operation is being executed and when there is no input from a user through the operation unit 131 or the touch panel 133 for a predetermined period of time.

In a backup wake mode (to be also referred to as a power saving mode 3 hereinafter) (the backup-time standby state), the image forming unit 16 is set in an "OFF" state, and the operation display unit 13, the HDD 118, and the CPU of the control unit 111 are set in an "ON" state. The backup wake mode, as described below, is a mode to which the image forming apparatus 10 shifts when the backup operation or the restore operation is being executed and when a user executes a predetermined recovering operation through the operation unit 131 or the touch panel 133.

Figure 4:
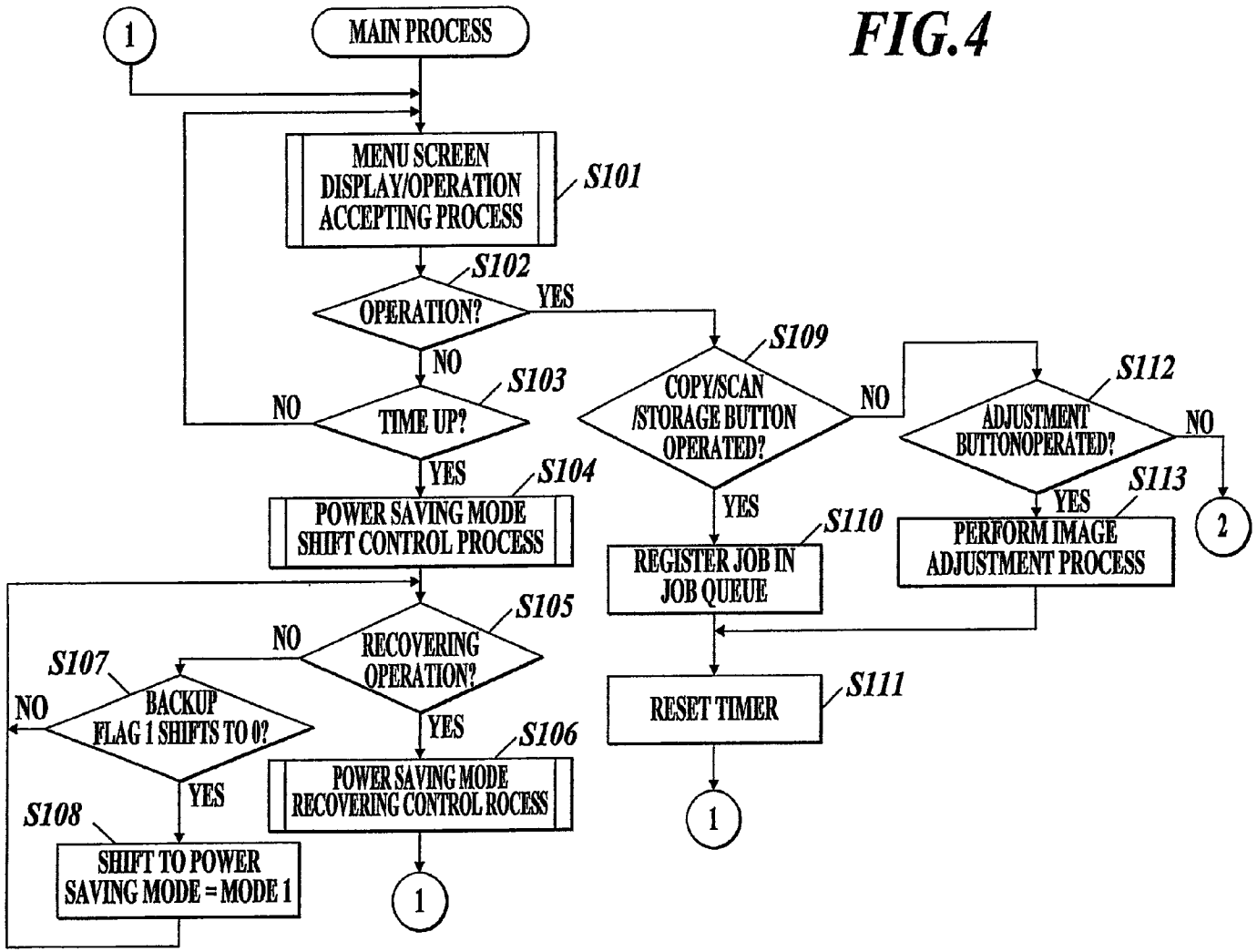
FIG. 4 is a flow chart explaining a main process to be executed in the image forming apparatus.
Figure 5:
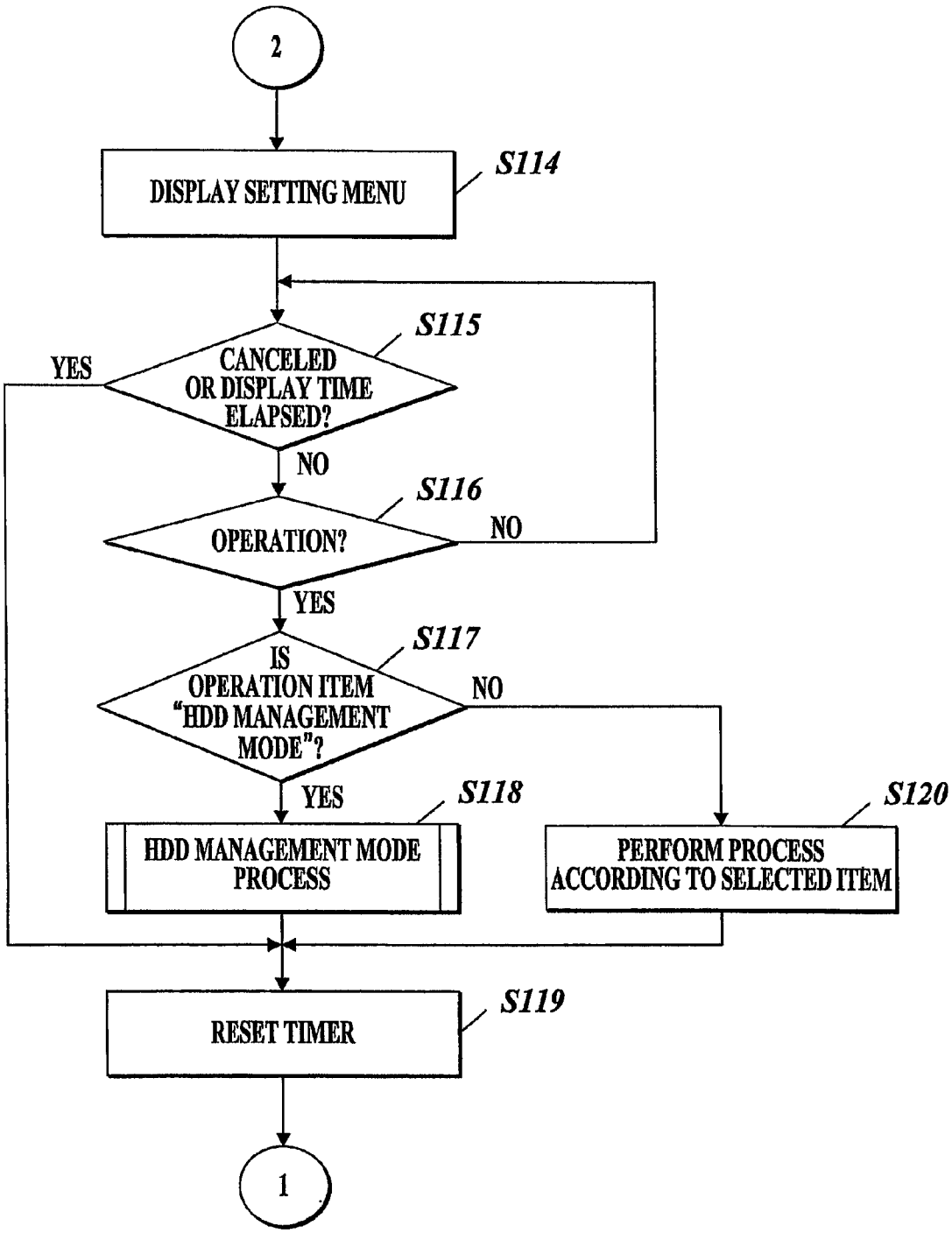
FIG. 5 is a flow chart explaining the main process to be executed in the image forming apparatus.

The main process to be executed in the image forming apparatus 10 is described below with reference to FIGS. 4 and 5.

When the power is turned on to execute the main process, the control unit 111 executes a menu screen display/operation accepting process, displays a predetermined menu screen, and executes a process of accepting an operation by a user on the operation display unit 13 (step S101). Detailed processing contents of the menu screen display/operation accepting process are described below.

The control unit 111 determines whether a user executes a selecting operation on the menu (step S102). When it is determined that the user does not execute the selecting operation (step S102: NO), the control unit 111 determines whether a time enough to shift to the standby state has elapsed (time is up) (step S103). More specifically, the control unit 111 determines whether the user executes the selecting operation by the time a predetermined period of time has elapsed after a final operation is executed and a monitoring timer is reset.

When it is determined that the time is not up (step S103: NO), the control unit 111 proceeds to the process in step S101. On the other hand, when it is determined that the time is up (step S103: YES), the control unit 111 executes a power saving mode shift control process and executes a process of changing modes depending on a state of the image forming apparatus 10 (step S104). Detailed processing contents of the power saving mode shift control process are described below.

Next, the control unit 111 determines whether the user executes a predetermined recovering operation through the operation unit 131 or the touch panel 133 (step S105). When it is determined that the recovering operation is executed (step S105: YES), the control unit 111 executes the power saving mode recovering control process and executes a process of changing modes depending on the state of the image forming apparatus 10 (step S106). Detailed processing contents of the power saving mode recovering control process are described below.

On the other hand, when it is determined in step S105 that the recovering operation is not executed (step S105: NO), the control unit 111 determines whether a backup flag is changed from 1 to 0 (step S107). The backup flag mentioned here is a flag showing the backup operation or the restore operation is being executed. As described below, "1" is set when the backup operation or the restore operation is executed, and "0" is set when the backup operation or the restore operation is ended. When it is determined whether the backup flag is changed from 1 to 0 (step S107: YES), the control unit 111 proceeds to the process in step S105 after the control unit 111 makes the image forming apparatus 10 shift to the power saving mode 1 (step S108). On the other hand, when it is determined that the backup flag is not changed from 1 to 0 (step S107: NO), the control unit 111 proceeds to the process in step S105 without executing the process in step S108.

Figure 13:
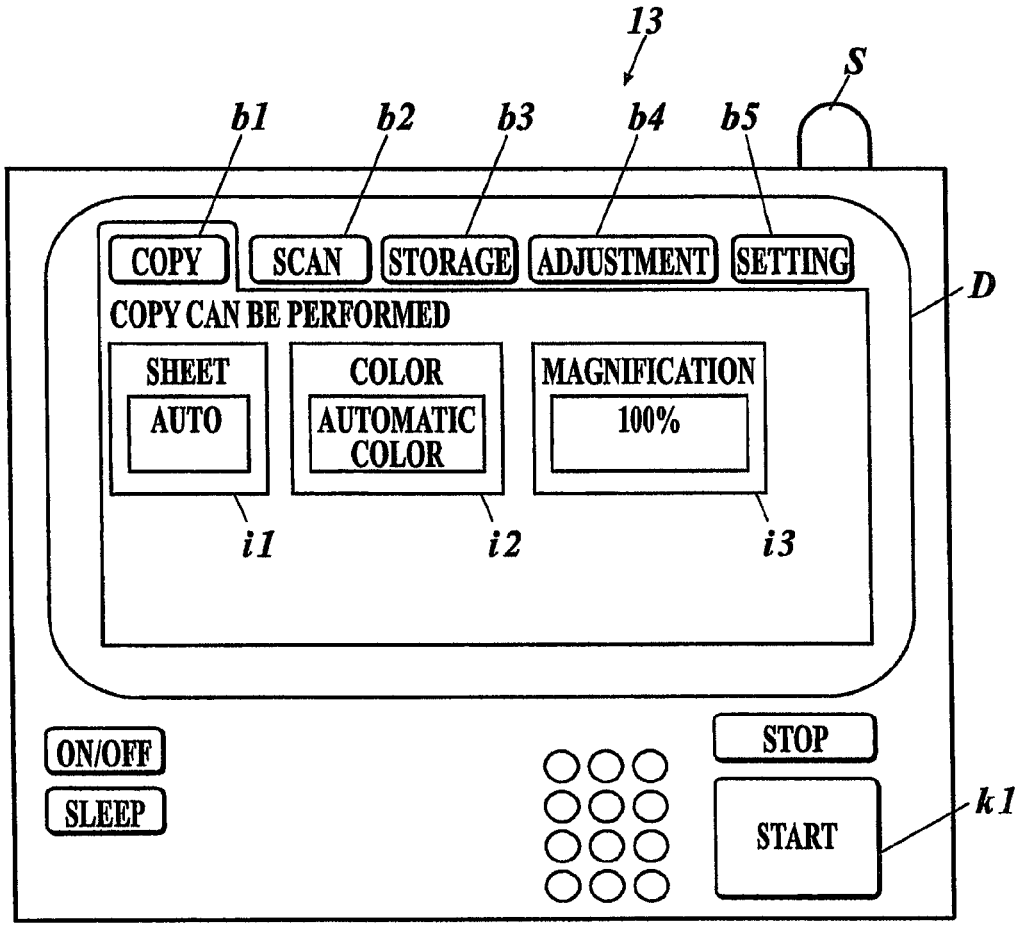
FIG. 13 is a diagram illustrating an example of an operation screen to be displayed in execution of the menu screen display/operation accepting process.

When it is determined in step S102 that the user executes the selecting operation (step S102: YES), the control unit 111 determines whether the operation is executed on any one of a "COPY" button and a "SCAN" button, and a "STORAGE" button (step S109). The "COPY" button, the "SCAN" button and the "STORAGE" button correspond to a "COPY" button b1, a "SCAN" button b2, and the "STORAGE" button b3 respectively, displayed on a display area D of the LCD illustrated in FIG. 13. After the user presses a position where any one of the buttons is displayed, the user operates a "START" button k1 of the operation unit 131, and thereby, the operation to be executed is determined. When it is determined that the operation is executed on any one of the "COPY" button, the "SCAN" button and the "STORAGE" button (step S109: YES), the control unit 111 registers the contents of the job to be executed in a job queue (step S110), resets the monitoring timer for judging the timing of shifting to the standby state (step S111), and then proceeds to the process in step S101.

On the other hand, when it is determined in step S109 that the operation is not executed on any one of the "COPY" button, the "SCAN" button, and the "STORAGE" button, that is, when the operation is neither "COPY", "SCAN" nor "STORAGE" (step S109: NO), the control unit 111 determines whether the operation is executed on an "adjustment" button (step S112). The "adjustment" button corresponds to an "adjustment" button b4 displayed on the display area D of the LCD illustrated in FIG. 13. When the user presses a position of the "adjustment" button b4, the control unit 111 makes a judgment about the operation.

When it is determined that the operation is executed on the "adjustment" button b4 (step S112: YES), the control unit 111 displays a predetermined screen for adjustment on the display area D, executes an image adjustment process which enables adjustment of parameters related to an image to be output, such as gamma adjustment or color adjustment (step S113), and proceeds to the process in step S111.

Figure 17:
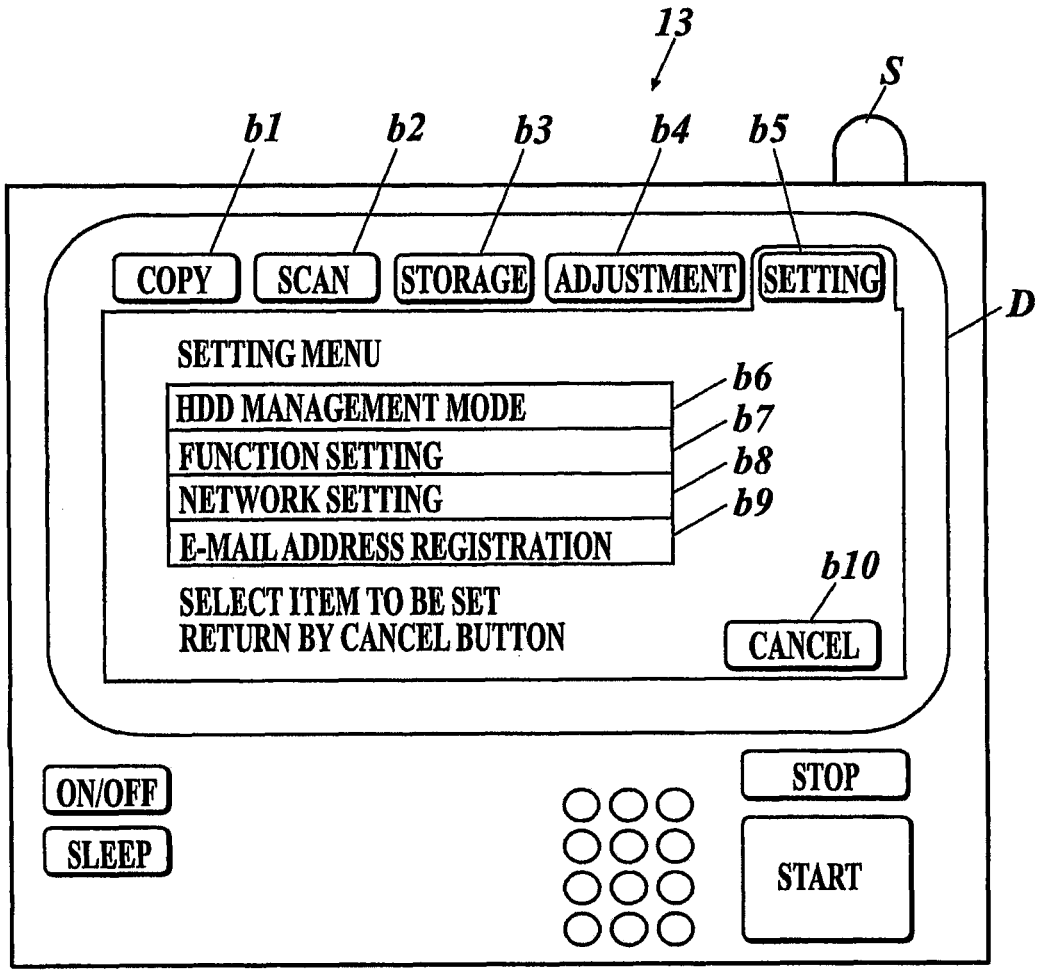
FIG. 17 is a diagram illustrating an example of an operation screen to be displayed in execution of the main process.

On the other hand, when it is determined that the operation is not executed on the "adjustment" button (step S112: NO), the control unit 111 determines that the operation is executed on a "setting" button, displays a predetermined setting menu, and accepts various operations (step S114). More specifically, the control unit 111 displays a setting menu screen as illustrated in FIG. 17 on the display area D of the LCD. On the setting menu screen, an "HDD management mode" button b6, a "function setting" button b7, a "network setting" button b8, and an "e-mail address registration" button b9 are displayed, and a "cancel" button b10 is displayed at a lower right part of the screen. With respect to the buttons b6 to b10, an operation is accepted when a user presses a position where each of the buttons is displayed.

At an upper right end of the operation display unit 13, a status LED (Light-Emitting Diode) S to display the state of the image forming apparatus 10 is provided. For example, the status LED S is set in an ON state in the normal mode, the status LED S is set in a flickering state in a predetermined mode during the backup operation and the restore operation, and the status LED S is set in an OFF state in the normal power saving mode.

Figure 18:
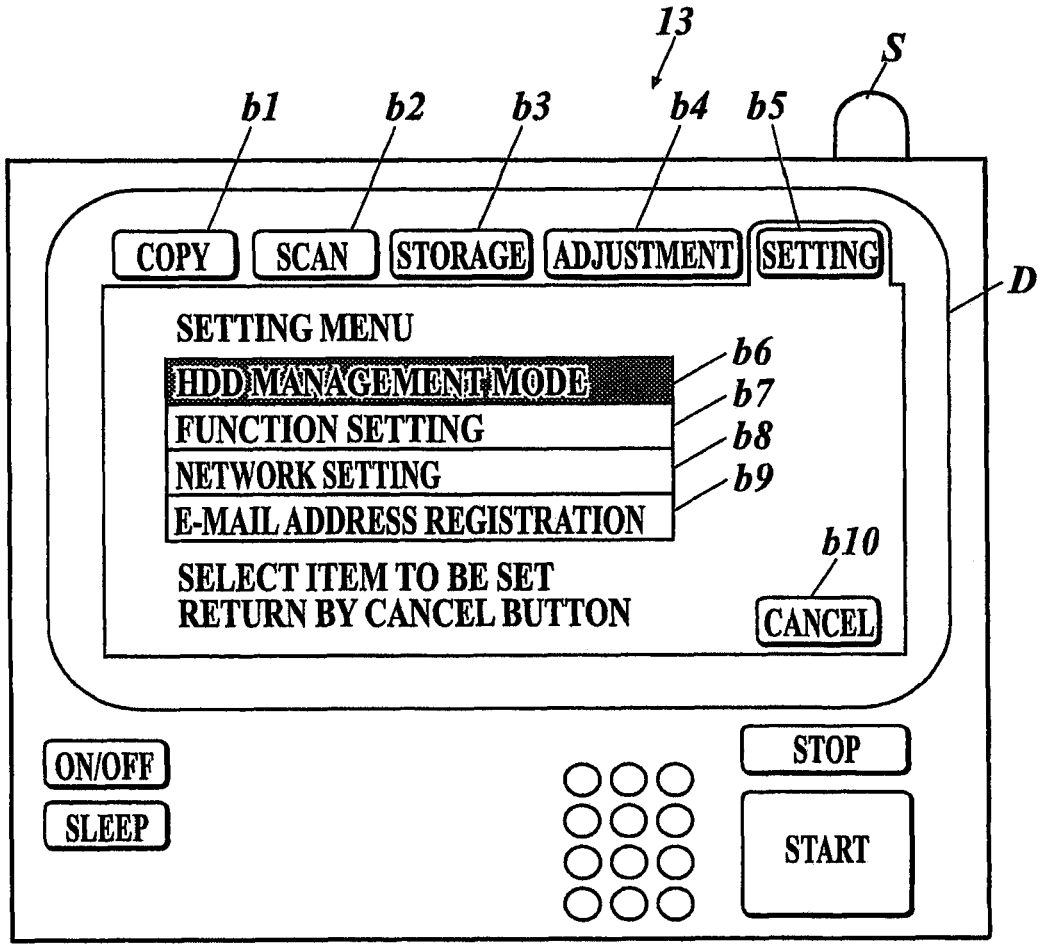
FIG. 18 is a diagram illustrating an example of an operation screen to be displayed in execution of the main process.

In the embodiment, during execution of a copy job, a scan job, a print job, and a job storage, the control unit 111, as illustrated in FIG. 18, displays the "HDD management mode" button b6 with shading applied thereto, and controls the operation acceptance so that the buttons may not accept an operation, and thereby the HDD management mode is prohibited from being selected.

The control unit 111 determines whether a cancel operation is executed or whether a predetermined display time has elapsed since the setting menu appears on the screen (step S115). More specifically, the control unit 111 determines whether the "cancel" button b10 displayed on the display area D is operated or whether a predetermined period of time has elapsed without any user operation since the setting menu appears on the screen.

When it is determined that the cancel operation is not executed or the predetermined display time has not elapsed since the setting menu appears on the screen (step S115: NO), the control unit 111 determines whether any one of the setting buttons b6 to b9 displayed on the setting menu screen is operated (step S116). On the other hand, when it is determined that the cancel operation is executed or whether the predetermined display time has elapsed since the setting menu appears on the screen (step S115: YES), the control unit 111 resets the monitoring timer for judging the timing of shifting to the standby state described above (step S119) and then proceeds to the process in step S101.

When it is determined in step S116 that any one of the setting buttons b6 to b9 displayed on the setting menu screen is operated (step S116: YES), the control unit 111 determines whether an operated item is an "HDD management mode" (step S117). More specifically, the control unit 111 determines whether the "HDD management mode" button b6 is operated. On the other hand, when it is determined in step S116 that any one of the setting buttons b6 to b9 displayed on the setting menu screen is not operated (step S116: NO), the control unit 111 proceeds to the process in step S115.

When it is determined in step S117 that the operated item is the "HDD management mode" (step S117: YES), the control unit 111 displays an HDD management mode menu to execute a backup operation or a restore operation, executes the HDD management mode process to accept various operations (step S118), and proceeds to the process in step S119. Detailed processing contents of the HDD management mode process are described below.

On the other hand, when it is determined in step S117 that the operated item is not the "HDD management mode" (step S117: NO), the control unit 111 executes a process according to the selected item (step S120), and proceeds to the process in step S119.

Figure 6:
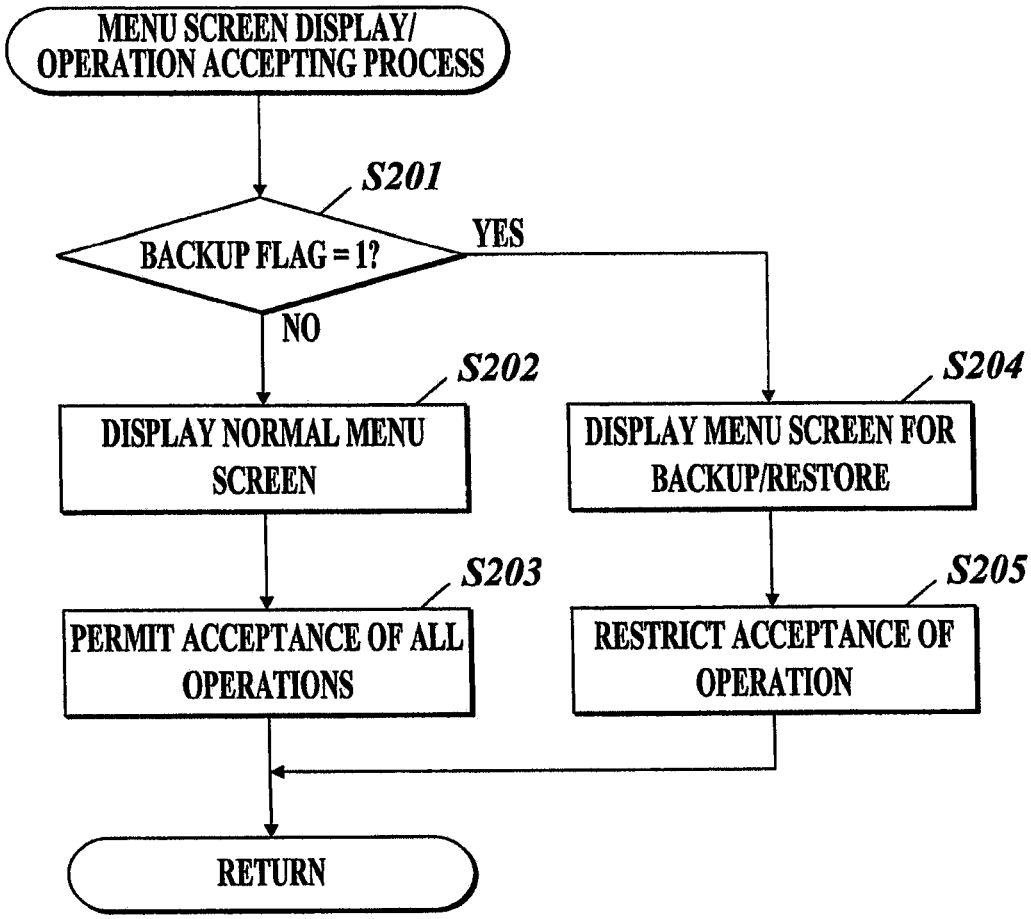
FIG. 6 is a flow chart explaining a menu screen display/operation accepting process to be executed in the image forming apparatus.

Next, the menu screen display/operation accepting process to be executed in step S101 is described below with reference to FIG. 6.

The control unit 111 determines whether the backup flag is 1, that is, whether the backup flag is set (step S201). When it is determined that the backup flag is not set (step S201: NO), the control unit 111 displays a normal menu screen illustrated in FIG. 13 on the display area D of the LCD (step S202). More specifically, when step S202 is executed, as the normal menu screen, a copy setting screen to be displayed when the "COPY" button b1 is operated is displayed as a default screen, and item buttons i1 to i3 to perform a copy setting are displayed on the copy setting screen. The status LED S is set in an ON state.

The control unit 111 executes a process of permitting acceptance of all operations without setting limitation about anytime which can be selected on the menu screen (step S203). In this manner, a user can execute a selecting operation for all the items on the normal menu. The control unit 111 executes the process in step S203 and then ends the process.

Figure 14:
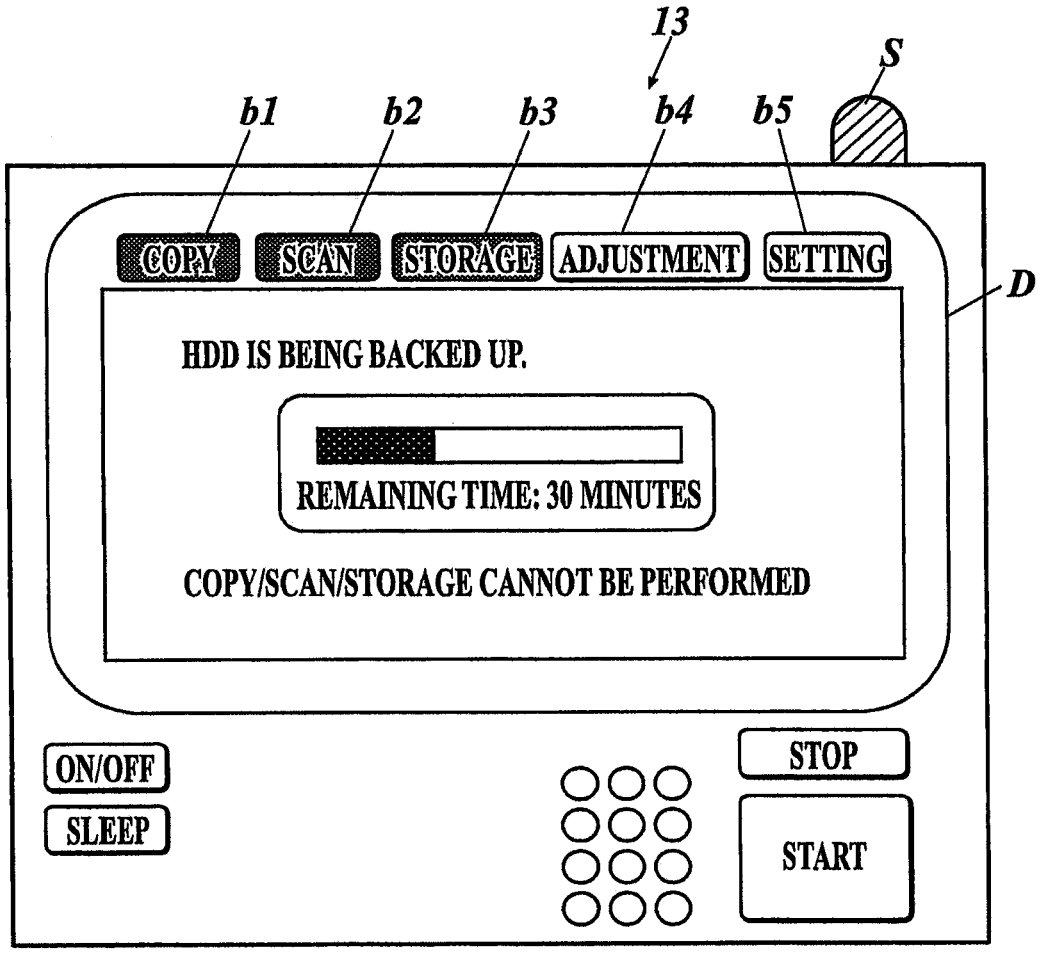
FIG. 14 is a diagram illustrating an example of an operation screen to be displayed in execution of the menu screen display/operation accepting process.

On the other hand, when it is determined that the backup flag is set (step S201: YES), the control unit 111 displays a backup/restore menu screen as illustrated in FIG. 14 on the display area D of the LCD (step S204). More specifically, when step S204 is executed, a screen, which shows that a backup operation or a restore operation is being executed and shows the progress thereof, is displayed as the backup/restore menu screen. On the screen, the "COPY" button b1, the "SCAN" button b2 and the "STORAGE" button b3 are displayed with shading applied thereto, which shows that the operations of "COPY", "SCAN" and "STORAGE" cannot be accepted. The status LED S flickers in a predetermined mode.

The control unit 111 prevents a user operation on a predetermined item among the selectable items on the menu screen, and executes a process of preventing the acceptance of a user operation, as to the predetermined item prevented from being selected (step S205). More specifically, the control unit 111 prohibits the acceptance of the operations of the "COPY" button b1, the "SCAN" button b2, and a "storage" button b3 to prevent execution of the copy job, the scan job and the job storage on which the backup operation and the restore operation may influence. The control unit 111 executes the process in step S205 and then ends the process.

Figure 7:
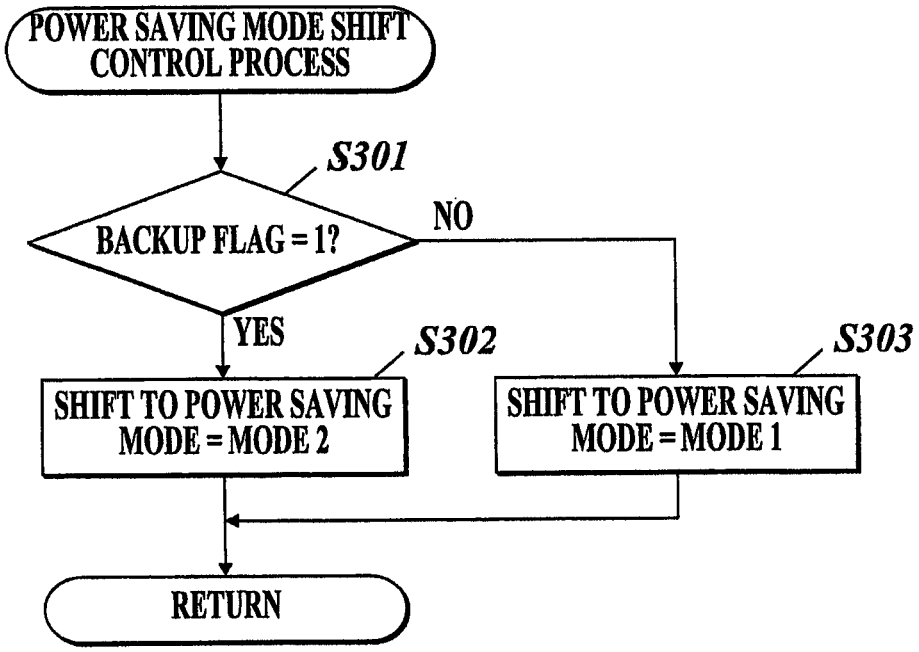
FIG. 7 is a flow chart explaining a power saving mode shift control process to be executed in the image forming apparatus.

Next, the power saving mode shift control process to be executed in step S104 is described below with reference to FIG. 7.

Figure 15:
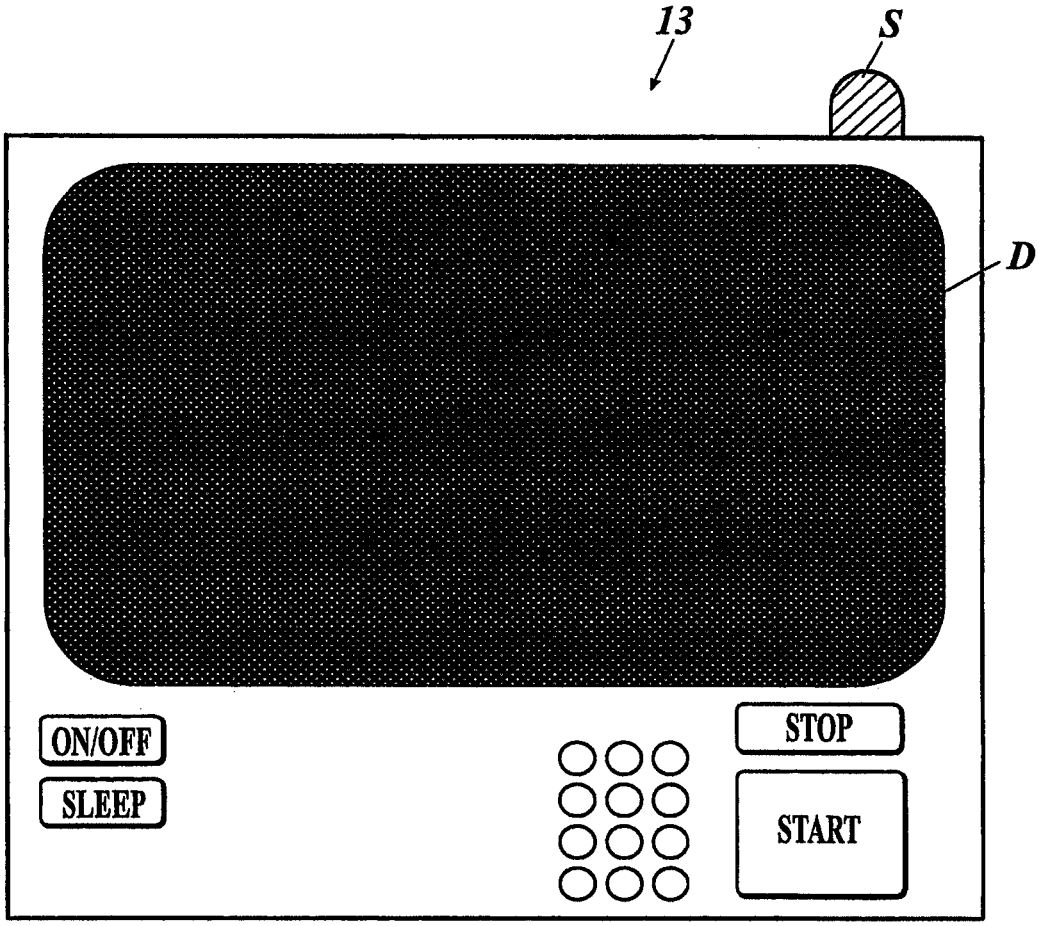
FIG. 15 is a diagram illustrating an example of an operation screen to be displayed in execution of the power saving mode shift control process.

First, the control unit 111 determines whether the backup flag is 1, that is, whether the backup flag is set (step S301). When it is determined that the backup flag is set (step S301: YES), the control unit 111 executes a process of making the image forming apparatus 10 shift to the power saving mode 2 described above (step S302), and then ends the process. In this case, the control state of the image forming apparatus 10 before shifting to the power saving mode 2, as described below, is a power saving mode 3. More specifically, when a time is up according to the monitoring timer set after the last operation is executed and a predetermined standby state shift condition is satisfied, the control unit 111 makes the image forming apparatus 10 shift from the power saving mode 3 to the power saving mode 2. Accordingly, the operation display unit 13, which is operating, stops operating. As a result, as illustrated in FIG. 15, the LCD is turned off, nothing is displayed on the display area D, and the operation unit 131 and the touch panel 133 are also set in a predetermined standby state. The status LED S is set in a flickering state showing that the backup operation or the restore operation is being executed.

Figure 16:
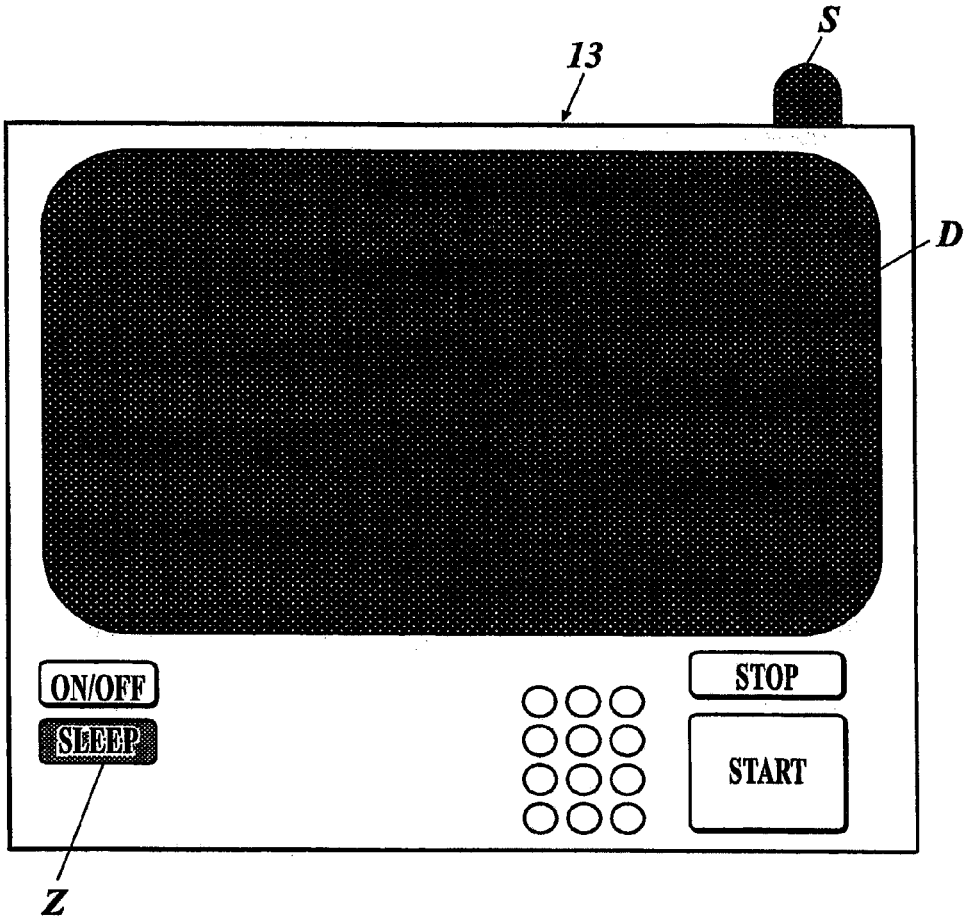
FIG. 16 is a diagram illustrating an example of an operation screen to be displayed in execution of the power saving mode shift control process.

When it is determined that the backup flag is not set (step S301: NO), the control unit 111 executes a process of making the image forming apparatus 10 shift to the power saving mode 1 described above (step S303), and then ends the process. More specifically, as described below, when a time is up according to the monitoring timer after the execution of a job, the control unit 111 executes a process of making the image forming apparatus 10 shift from the normal mode (the operating state) to the power saving mode 1 (the non-backup-time standby state). As a result, as illustrated in FIG. 16, the LCD is turned off, nothing is displayed on the display area D, and the operation unit 131 and the touch panel 133 are also set in a predetermined standby state, and a SLEEP-LED Z provided at a lower left part of the operation display unit 13 flickers in a predetermined mode to show that the image forming apparatus 10 is in the power saving mode 1. The status LED S is turned off to show that neither the backup operation nor the restore operation is being executed.

In the embodiment, as long as the backup flag is set, the image forming apparatus 10 does not shift to the power saving mode 1. That is, while backup control is executed, the shift to the power saving mode 1 is prevented.

According to the execution of the above processes, when the time is up according to the monitoring timer set after the last operation is executed and a predetermined standby state shift condition is satisfied, the image forming apparatus 10 shifts from the normal mode to the power saving mode 1 or from the power saving mode 3 to the power saving mode 2 depending on whether the backup control is being executed. Accordingly, as illustrated in FIG. 3, the units which stop operating are different depending on a shift of the modes. More specifically, of the plurality of operating units, one or more of the units stop operating depending on a result obtained by determining whether the backup flag is set.

In particular, the HDD 118 does not stop operating as long as the backup control is being executed.

Since the image forming apparatus 10 shifts to the power saving mode 2, the HDD 118 operates, and the image forming unit 16 and the operation display unit 13 stop operating.

Figure 8:
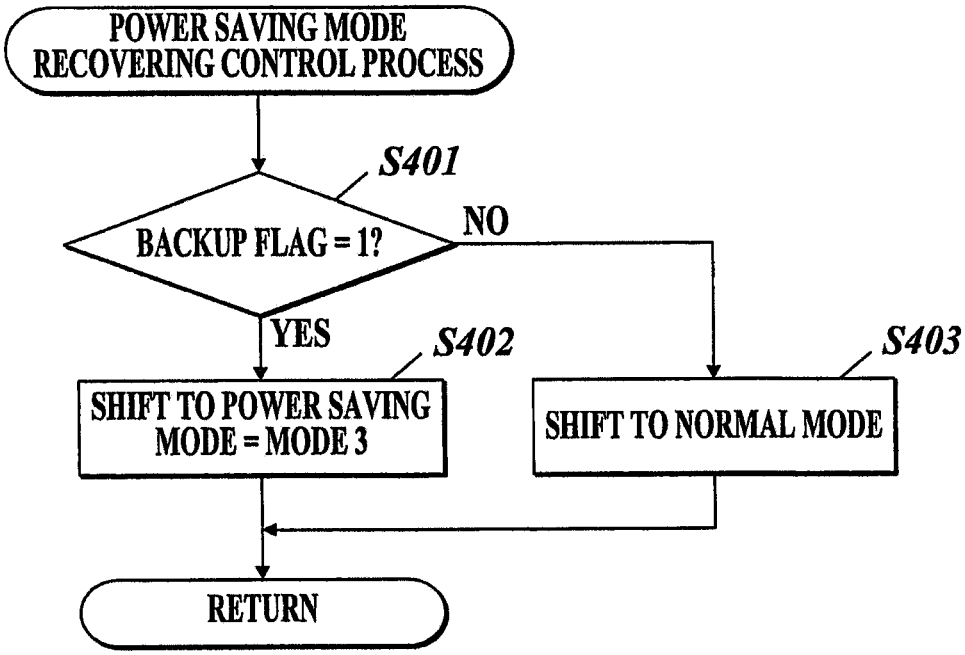
FIG. 8 is a flow chart explaining a power saving mode recovering control process to be executed in the image forming apparatus.

Next, the power saving mode recovering control process to be executed in step S106 is described below with reference to FIG. 8.

First, the control unit 111 determines whether the backup flag is 1, that is, whether the backup flag is set (step S401). When it is determined that the backup flag is set (step S401: YES), the control unit 111 executes a process of making the image forming apparatus 10 shift to the power saving mode 3 described above (step S402), and then ends the process. In this case, the control state of the image forming apparatus 10 before shifting to the power saving mode 3 is the power saving mode 2. More specifically, the image forming apparatus 10 shifts from the power saving mode 2 to the power saving mode 3 if the control unit 111 detects a predetermined recovering operation when the operation display unit 13 is non-operating. Then, the operation unit 131 and the touch panel 133, which are non-operating, are recovered and it becomes possible to execute control according to operations.

On the other hand, when it is determined that the backup flag is not set (step S401: NO), the control unit 111 executes a process of making the image forming apparatus 10 shift to the normal mode described above (step S403), and then ends the process.

According to the execution of the above processes, when a predetermined recovering operation is executed to satisfy a predetermined recovering condition, it is determined whether the backup control is being executed, and the image forming apparatus 10 shifts to any one of the normal mode and the power saving mode 3. Thus, a unit starts operating again depending on the mode to which the image forming apparatus 10 shifts.

When it is determined that the backup control is not being executed, the image forming apparatus 10 shifts to the normal mode, and the image forming unit 16 starts operating again.

Figure 9:
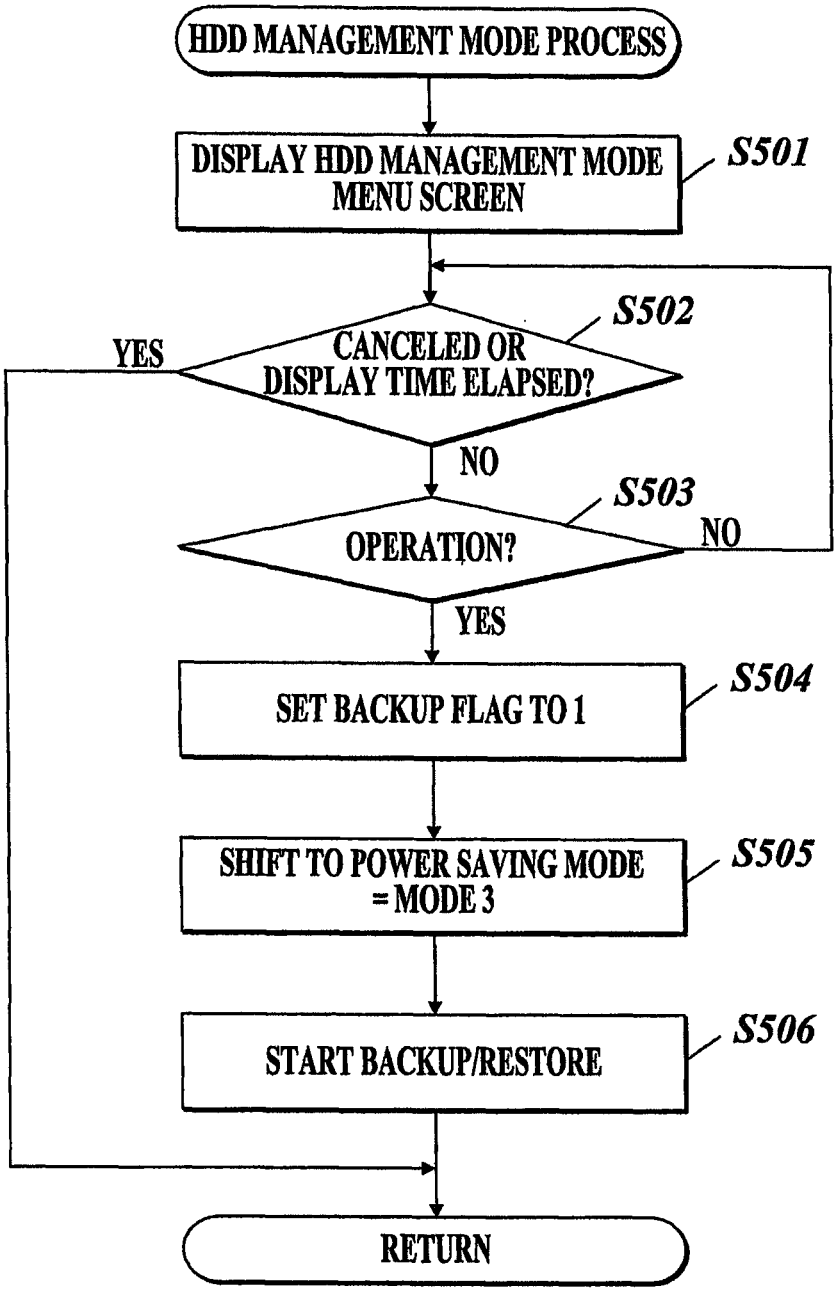
FIG. 9 is a flow chart explaining an HDD management mode process to be executed in the image forming apparatus.

Next, the HDD management mode process to be executed in step S118 is described below with reference to FIG. 9.

Figure 19:
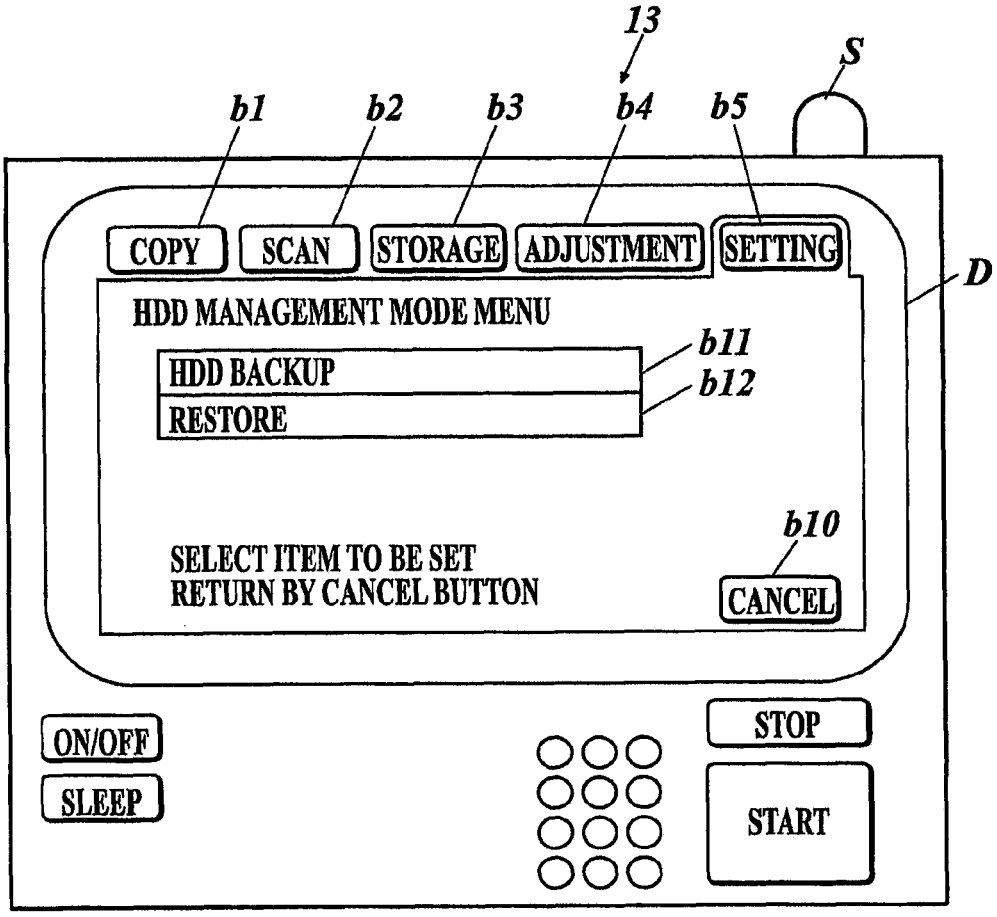
FIG. 19 is a diagram illustrating an example of an operation screen to be displayed in execution of the HDD management mode process.

First, the control unit 111 executes control to display an HDD management mode menu screen (step S501). More specifically, when a control state of the image forming apparatus 10 is the normal mode, the control unit 111 displays the HDD management mode menu screen as illustrated in FIG. 19 on the display area D of the LCD. On the HDD management mode menu screen, an "HDD backup" button b11 and a "restore" button b12 are displayed, and a "cancel" button b10 is displayed at a lower right part of the screen. The status LED S is set in an ON state showing that the normal mode is set.

Figure 20:
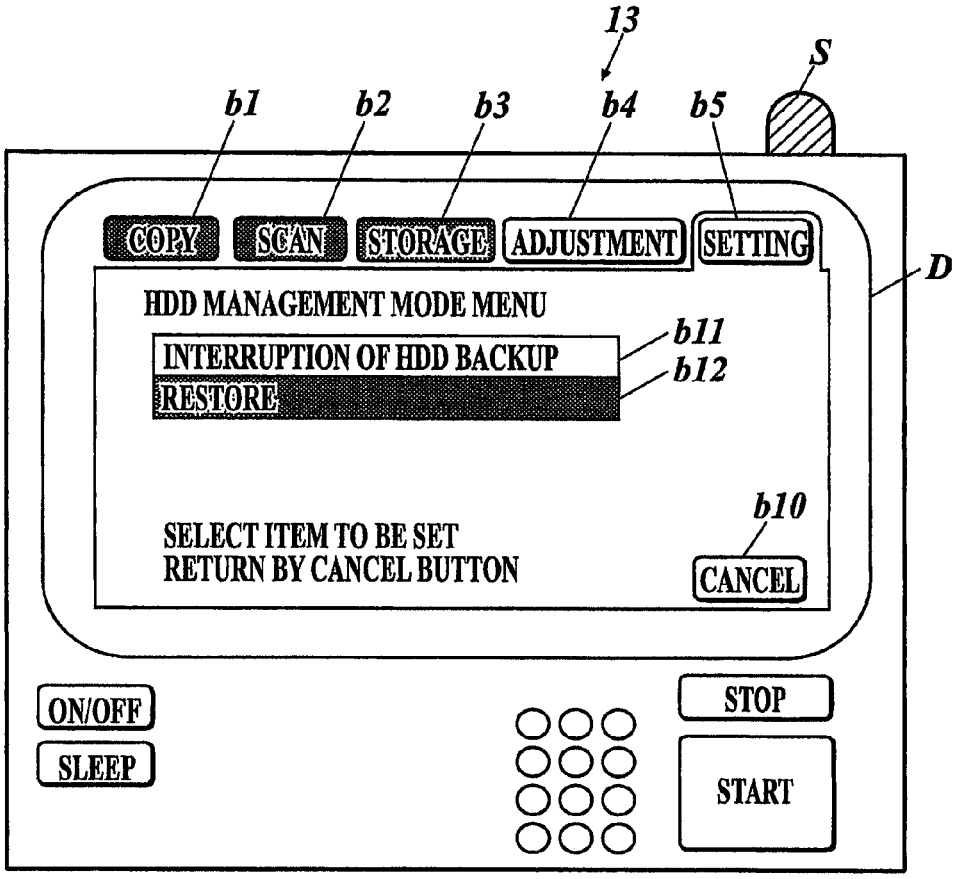
FIG. 20 is a diagram illustrating an example of an operation screen to be displayed in execution of the HDD management mode process.

In the embodiment, during a backup operation and a restore operation, the control unit 111, as illustrated in FIG. 20, displays the "restore" button b12 with shading applied thereto, and controls the operation acceptance so that the button b12 may not accept an operation, and thereby, execution of the other item related to HDD management is prevented. The control unit 111 performs control such that the "HDD backup" button b11 is changed into an "HDD backup interruption" button to interrupt an active backup operation and that the "HDD backup" button b11 accepts the operation for interruption of the backup operation. The control unit 111 displays the "COPY" button b1, the "SCAN" button b2 and the "STORAGE" button b3 with shading applied thereto, and controls the operation acceptance so that the buttons b1 and b2 may not accept an operation.

Next, the control unit 111 determines whether the cancel operation is executed and whether a predetermined display time has elapsed since the HDD management mode menu appears on the screen (step S502). More specifically, the control unit 111 determines whether the "cancel" button b10 button displayed on the display area D is operated or whether a predetermined period of time has elapsed without any user operation since the HDD management mode menu appears on the screen.

Figure 21:
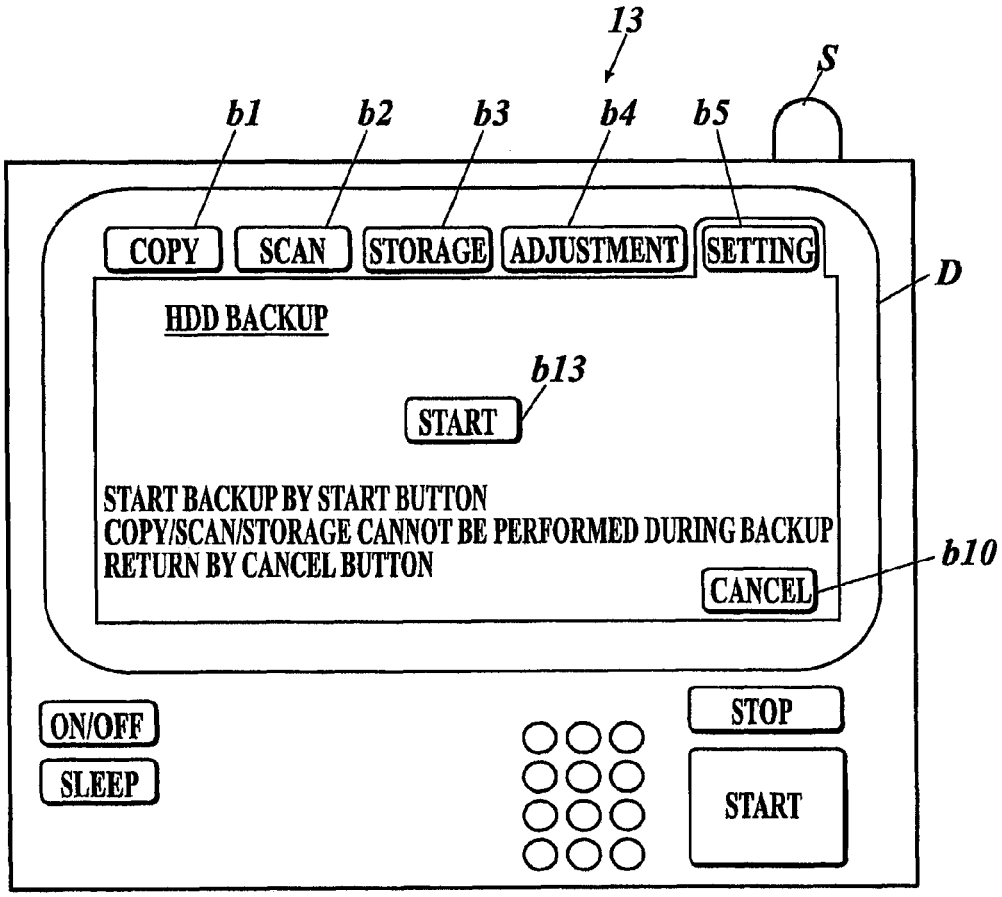
FIG. 21 is a diagram illustrating an example of an operation screen to be displayed in execution of the HDD management mode process.

When it is determined that the cancel operation is not executed or that the predetermined display time has not elapsed since the HDD management mode menu appears on the screen (step S502: NO), the control unit 111 determines whether the HDD backup operation or the restore operation is executed (step S503). More specifically, after any of the setting buttons b11 and b12 displayed on the HDD management mode menu screen is operated, and one of the HDD backup operation and the restore operation to be executed is selected, the control unit 111 determines whether an operation for executing the selected operation is performed. For example, on the HDD management mode menu screen illustrated in FIG. 19, when the operation of the "HDD backup" button b11 is detected, the control unit 111 displays a screen, as illustrated in FIG. 21, to confirm execution of the backup operation on the display area D of the LCD. The control unit 111 detects the operation of a "START" button b13 displayed on a backup execution confirmation screen and thereby, determines that a backup operation is executed.

On the other hand, when it is determined that the cancel operation is executed or whether the predetermined display time has elapsed since the setting menu appears on the screen (step S502: YES), the control unit 111 ends the process.

When it is determined in step S503 that any one of the setting buttons b11 and b12 displayed on the HDD management mode menu screen is operated (step S503: YES), the control unit 111 sets the backup flag to 1 to set the backup flag (step S504). Then, the control unit 111 executes a process of making the image forming apparatus 10 shift to the power saving mode 3 (step S505). The control state of the image forming apparatus 10 before shifting to the power saving mode 3 is the normal mode. Next, the control unit 111 starts a backup operation or a restore operation (step S506). More specifically, when the control unit 111 starts the backup operation, the control unit 111 stores all or some of the various pieces of information, stored in the HDD 118, in the PC 30 or the external memory device 40, as backup data. On the other hand, when the control unit 111 starts the restore operation, the control unit 111 writes the backup data stored in the PC 30 or the external memory device 40 back to the HDD 118. The control unit 111 starts the backup operation or the restore operation in step S506 and then ends the process.

On the other hand, when it is determined in step S503 that any one of the setting buttons b11 and b12 is not operated (step S503: NO), the control unit 111 proceeds to the process in step S502.

According to the execution of the above processes, the control state of the image forming apparatus 10 shifts from the normal mode to the power saving mode 3 with the backup control.

When the image forming apparatus 10 shifts to the power saving mode 3, the image forming unit 16 stops operating, and the operation display unit 13 remains operating. Hence, the operations of the operation unit 131 and the touch panel 133 can be accepted.

Figure 10:
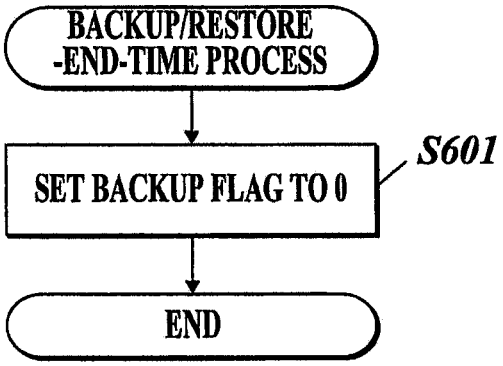
FIG. 10 is a flow chart explaining a backup/restore-end-time process to be executed in the image forming apparatus.

Next, the backup/restore-end-time process to be executed in the image forming apparatus 10 is described below with reference to FIG. 10. This process is an interrupt process which is to be activated when the control unit 111 detects the completion of a backup operation or a restore operation.

When the control unit 111 starts the backup/restore-end-time process, the control unit 111 sets the backup flag to 0 to clear the backup flag (step S601), and then ends the process.

Figure 11:
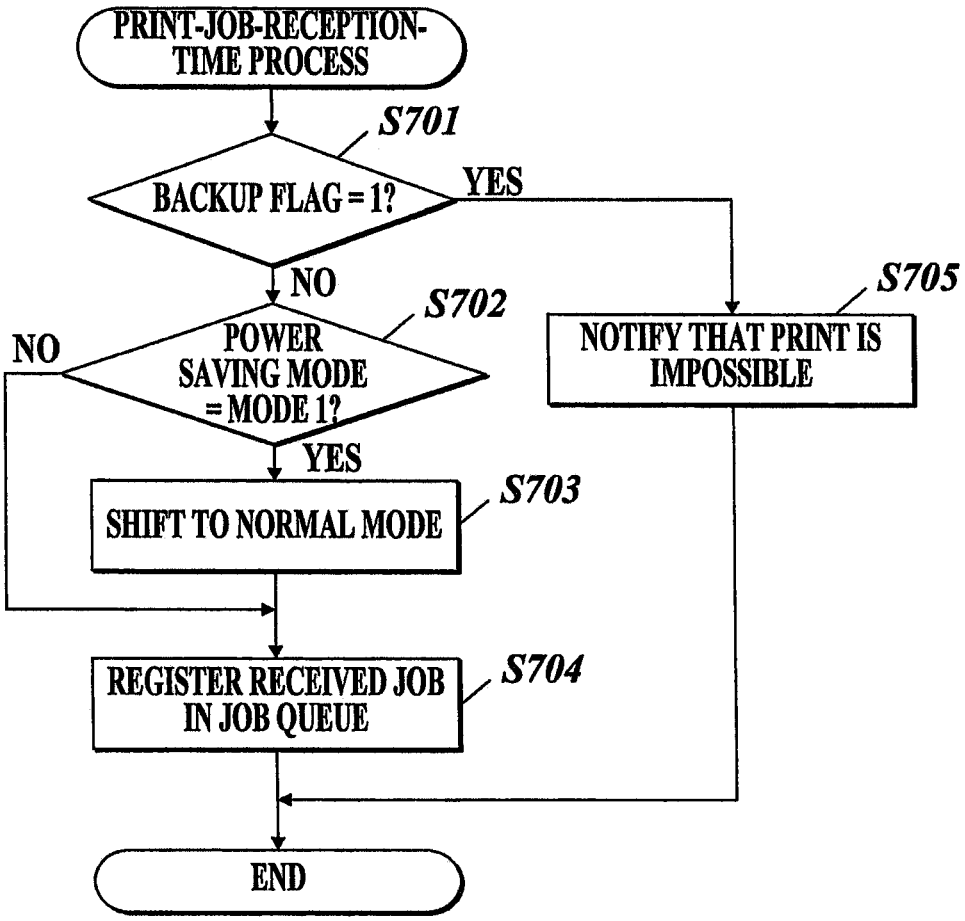
FIG. 11 is a flow chart explaining a print-job-reception-time process to be executed in the image forming apparatus.

Next, the print-job-reception-time process to be executed in the image forming apparatus 10 is described below with reference to FIG. 11. This process is an interrupt process which is to be activated when the control unit 111 detects that the control unit 111 receives print job data from a host apparatus such as the PC 30. When the image forming apparatus 10 is in the power saving mode 1 described above, the CPU of the control unit 111 is recovered from the system reset state, and the print-job-reception-time process is executed.

First, the control unit 111 determines whether the backup flag is 1, that is, whether backup flag is set (step S701). When it is determined that the backup flag is not set (step S701: NO), the control unit 111 determines whether the control state of the image forming apparatus 10 is the power saving mode 1 (step S702).

When it is determined that the control state is the power saving mode is 1 (step S702: YES), the control unit 111 makes the image forming apparatus 10 shift to the normal state described above (step S703), and then registers the received print job in a job queue (step S704). After executing the process in step S704, the control unit 111 ends the process.

On the other hand, when it is determined in step S702 that the control state is not the power saving mode 1 (step S702: NO), that is, when it is determined that the control state of the image forming apparatus 10 is already the normal mode described above, the control unit 111 proceeds to the process in step S704 without executing the process in step S703.

When it is determined in step S701 that the backup flag is set (step S701: YES), the control unit 111 notifies the host apparatus serving as a source of the print job data transmission that a print operation is impossible (step S705) and then ends the process. More specifically, since the print job is prohibited from being executed during the backup operation or the restore operation, the control unit 111 notifies that the received print job cannot be executed and that the print operation is impossible.

In the embodiment, when job data to be stored in the HDD 118 is transmitted from the host apparatus such as the PC 30 to request job storage and when the backup flag is set, the control unit 111 also notifies that the job storage is impossible.

Figure 12:
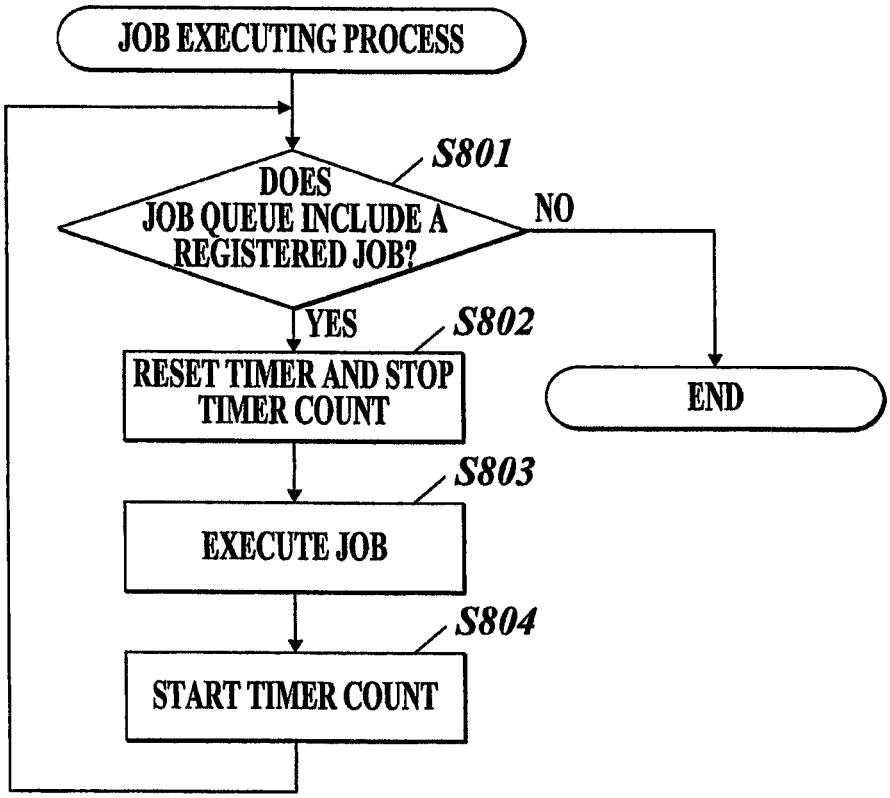
FIG. 12 is a flow chart explaining a job executing process to be executed in the image forming apparatus.

Next, a job executing process to be executed in the image forming apparatus 10 is described below with reference to FIG. 12. This process is an interrupt process which is to be activated at predetermined time intervals.

First, the control unit 111 determines whether the job queue includes a registered job (step S801). More specifically, when various jobs are registered in step S110 in the main process illustrated in FIG. 4 or step S704 in the print-job-reception-time process illustrated in FIG. 11, the control unit 111 determines that the process includes a registered job.

When it is determined that the job queue includes a registered job (step S801: YES), the control unit 111 resets the monitoring timer for judging the timing of shifting to the standby state described above, stops the progress of the monitoring timer (step S802), reads the job data registered earliest in the job queue, and executes the job of the job data (step S803). After the job is finished, the control unit 111 starts the progress of the monitoring timer (step S804) and proceeds to the process in step S801.

On the other hand, when it is determined in step S801 that the job queue does not include a registered job (step S801: NO), the control unit 111 ends the process.

According to the above-mentioned configuration in the embodiment, a backup operation can be executed anytime a user desires, although, in a conventional image forming apparatus, a backup operation cannot be executed at an arbitrary timing.

In a conventional image forming apparatus in which the backup operation is executed at the timing when the image forming apparatus shifts to a standby state, a timing when the backup operation is executed depends on a timing when the image forming apparatus shifts to the standby state. In addition, in the conventional image forming apparatus, the backup operation is executed when the apparatus falls into a standby state. Accordingly, when the backup operation is executed at an unintended timing for a user, an image cannot be formed even though the image forming is required. As a result, in the conventional image forming apparatus, working efficiency is deteriorated. In particular, in the quick printing industry, in response to customers' request, operations may be executed around the clock, and an image forming apparatus may not be able to perform a backup operation at a predetermined time in the night etc. According to the embodiment, such a problem can be solved.

As described above, according to the embodiment, the HDD 118 stores various pieces of information. The control unit 111 executes backup control to store the information, stored in the HDD 118, in the PC 30 or the external memory device 40 and makes the image forming apparatus shift from the normal mode to the power saving mode. The control unit 111 makes the image forming apparatus shift from the normal mode to the power saving mode with the backup control. As a result, in the backup operation, power consumption can be reduced. In addition, since the backup operation can be executed anytime a user desires, working efficiency is improved.

According to the embodiment, the power saving modes include the backup wake mode (mode 3) and the backup power saving mode (mode 2) to which the image forming apparatus 10 shifts from the normal mode with the backup control, and the normal power saving mode (mode 1) to which the image forming apparatus 10 shifts from the normal mode without the backup control after job execution. As a result, since the image forming apparatus 10 can shift to the power saving mode at the time of the backup control in addition to the conventional power saving mode, power consumption can be efficiently reduced.

According to the embodiment, the control unit 111 makes the image forming unit 16 to form an image on a sheet stop operating, accepts operations to the operation unit 131 and the touch panel 133 to be operated by a user, and executes control according to the accepted operations in the backup wake mode (mode 3). As a result, even while a function of forming an image is stopped, a setting operation such as a setting of the image forming apparatus 10 can be executed. Therefore, the working efficiency can be improved while reducing power consumption.

According to the embodiment, when a predetermined standby state shift condition is satisfied in the backup wake mode (mode 3); the control unit 111 makes the operation unit 131 stop operating. As a result, power consumption can be more efficiently reduced.

According to the embodiment, since the control unit 111 prevents the image forming apparatus from shifting to the normal power saving mode (mode 1) during execution of the backup control, the units related to the backup control are prevented from unintentionally stopping operation.

According to the embodiment, the control unit 111 makes the HDD 118 operate, while the control unit 111 stops the function of the image forming unit 16 to form an image on a sheet and the functions of the operation unit 131 and the touch panel 133 to be operated by a user, in the backup power saving mode (mode 2). As a result, only the units required for a backup operation are made to operate, and the units such as the image forming unit and the operation unit, which consume large amount of electricity, are made to stop operating. Therefore, the power consumption can be more efficiently reduced.

According to the embodiment, the control unit 111 can execute control according to operations to the operation unit 131 and the touch panel 133 if the control unit 111 detects a predetermined recovering operation to the operation unit 131 and the touch panel 133 when the operation unit 131 and the touch panel 133 are non-operating. As a result, since a setting operation such as a setting of the image forming apparatus 10 becomes possible as needed, working efficiency can be improved while reducing power consumption.

According to the embodiment, the control unit 111 makes a plurality of units stop operating in the power saving mode. When a predetermined recovering condition is satisfied in the power saving mode, the control unit 111 determines whether the backup control is being executed. The control unit 111 makes a unit operate again, the unit corresponding to the determination result among the plurality of units which are non-operating. As a result, since it is possible to stop an operation of a unit which is prevented from operating during execution of the backup control, the image forming apparatus 10 can be efficiently operated, and power consumption can be reduced.

According to the embodiment, when the predetermined recovering condition is satisfied in the power saving mode, the control unit 111 makes the image forming unit 16, which is non-operating, operate again under the condition that the control unit 111 determines that the backup control is not being executed. As a result, since the image forming unit, which is prevented from operating, during execution of the backup control, can efficiently return to an operating state, the image forming apparatus 10 can be more efficiently operated, and power consumption can be reduced.

According to the embodiment, the HDD 118 stores various pieces of information. The control unit 111 executes backup control to store the information, stored in the HDD 118, into the external memory device 40 or the PC 30, and makes the image forming apparatus 10 shift from the normal mode to the power saving mode in which a plurality of units are non-operating. When the predetermined recovering condition is satisfied in the power saving mode, the control unit 111 determines whether the backup control is being executed. Then, the control unit 111 makes a unit operate again, the unit corresponding to the determination result among the plurality of units which are non-operating. As a result, since it is possible to stop an operation of a unit which is prevented from operating during execution of the backup control, the image forming apparatus 10 can be efficiently operated, and power consumption can be reduced.

According to the embodiment, the HDD 118 stores various pieces of information. The control unit 111 executes backup control to store the information, stored in the HDD 118, into the external memory device 40 or the PC 30, determines whether the backup control is being executed when a predetermined standby state shift condition is satisfied, and makes a unit stop operating, the unit corresponding to the determination result among the plurality of units which are operating. As a result, when the predetermined standby state shift condition is satisfied, only the units required for a backup operation are made to operate, and the other units which are not related to the backup operation are made to stop operating. Therefore, the image forming apparatus 10 can be efficiently operated, and power consumption can be reduced.

According to the embodiment, when the standby state shift condition is satisfied, the control unit 111 does not make the HDD 118 stop operating when it is determined that the backup control is being executed, and the control unit 111 makes the HDD 118 stop operating when it is determined that the backup control is not being executed. As a result, an operating state of the HDD, which is required for a backup operation, is controlled depending on whether the backup control is being executed. Therefore, the HDD 118 can be operated as needed, and accordingly, the image forming apparatus 10 can be more efficiently operated, and power consumption can be reduced.

According to the embodiment, the HDD 118 stores various pieces of information. The control unit 111 executes backup control to store the information stored, in the HDD 118, into the external memory device 40 or the PC 30 and makes the image forming apparatus 10 shift to the power saving mode in which an operating unit stops operating when the predetermined standby state shift condition is satisfied. The power saving modes include the backup wake mode (mode 3) and the backup power saving mode (mode 2) in which the HDD 118 does not stop operating and the normal power saving mode (mode 1) in which the units including the HDD 118 stop operating. As a result, in the power saving mode, the HDD 118 operates or stops operating depending on conditions, and thereby, the image forming apparatus 10 can be efficiently operated and power consumption can be reduced.

According to the embodiment, the control unit 111 determines whether the backup control is being executed when the standby state shift condition is satisfied to make the image forming apparatus 10 shift the power saving mode. When it is determined that the backup control is being executed, the control unit 111 makes the image forming apparatus 10 shift to the backup wake mode (mode 3) and the backup power saving mode (mode 2). When it is determined that the backup control is not being executed, the control unit 111 makes the image forming apparatus 10 shift to the normal power saving mode (mode 1). As a result, when the image forming apparatus 10 shifts from the normal mode to the power saving mode, the operating state of the HDD, which is required for a backup operation, is controlled depending on whether the backup control is being executed. Therefore, the HDD 118 can be operated as needed, and thereby, the image forming apparatus 10 can be more efficiently operated and power consumption can be reduced.

The description in the embodiment of the present invention is an example of the image forming apparatus according to the present invention, and the present invention is not limited to the description. Detailed configurations and detailed operations of functional units configuring the image forming apparatus can be appropriately changed.

In the embodiment, an image forming apparatus can be operated through an operation unit 131 and a touch panel 133 during a backup operation. However, the image forming apparatus may be prevented from being operated through the operation unit 131 and the touch panel 133 during the backup operation. In addition, any one of the operation unit 131 and the touch panel 133 may be made operable during the backup operation.

In the embodiment, when there is no user operation for a predetermined period of time, the operation unit 131 and the touch panel 133 stop operating during the backup operation. However, the operation unit 131 and the touch panel 133 may not stop operating during the backup operation.

In the embodiment, when the image forming apparatus shifts from the normal mode to the power saving mode, the display unit is made to operate when the mode shifting accompanies a start of the backup operation. On the other hand, when the image forming apparatus shifts from the normal mode to the power saving mode, the display unit is made to stop operating when the mode shifting does not accompany a start of the backup operation. However, regardless of whether the mode shifting accompanies the start of the backup operation, the display unit may be made to stop operating.

In the embodiment, the image forming apparatus shifts from the normal mode to the power saving mode when a backup operation is started and when there is no user operation for a predetermined period of time. However, the image forming apparatus may shift from the normal mode to the power saving mode only when the shift accompanies the start of the backup operation. The image forming apparatus may shift to the power saving mode depending on an operation of a user. Furthermore, a timer may be set to cause the image forming apparatus to shift to the power saving mode when a predetermined period of time has elapsed.

In the embodiment, the image forming apparatus shifts to the normal mode or the backup wake mode when a predetermined recovering operation is executed in the normal power saving mode or the backup power saving mode. However, a mode shift may be performed in another manner; for example, a manner in which a timer may be set to perform a mode shift when a predetermined period of time has elapsed.

In the embodiment, during a backup operation, the jobs such as a copy job, a scan job, a print job, and a job storage are prohibited from being executed. However, only registration of each of the jobs may be performed during the backup operation, and the registered job may be executed after the backup operation is finished.

In the embodiment, during a backup operation, the jobs such as a copy job, a scan job, a print job, and a job storage are prohibited from being executed. However, only the copy job and the print job may be prohibited from being executed, and the scan job and the job storage may be permitted to be executed during the backup operation. That is because execution of the copy job and the print job during the backup operation may cause an error because the backup operation hinders image forming processing; and on the other hand, the scan job and the job storage do not require image forming.

As to the data to be backed up from a nonvolatile memory such as an HDD into an external memory device or the like, all of the data stored in the nonvolatile memory may be backed up or a part of the data stored in the nonvolatile memory may be backed up. When a part of the data is to be backed up, the data to be backed up may be selected by a user.

As to the data to be restored from the external memory device or the like into the nonvolatile memory such as an HDD, all of the data stored in the external memory device may be restored, or a part of the data stored in the external memory device may be restored. When a part of the data is to be restored, the data to be restored may be selected by a user.

During a backup operation, a time required for the completion of the backup operation and a time required for the completion of warm-up of the image forming unit may be calculated, and the image forming unit may be controlled such that the warm-up of the image forming unit is completed at the end of the backup operation. In this manner, image formation can be rapidly performed after the backup operation is ended, and working efficiency can be improved.

The modifications described above can be applied to a restore operation as a matter of course.

In the embodiment, the example in which a hard disk drive, a nonvolatile semiconductor memory, or the like is used as a computer readable medium for a program according to the present invention. However, the present invention is not limited to the example. As another computer readable medium, a portable recording medium such as a CD-ROM can be applied. As a medium which provides data of the programs according to the present invention through a communication line, a carrier wave (carrier) is also applied.

The entire disclosure of Japanese Patent Application No. 2010-065590 filed on Mar. 23, 2010 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus comprising:

a memory unit to store various pieces of information; and a control unit to execute backup control to store information stored in the memory unit into an external memory device and to make the image forming apparatus shift from an operating state to a predetermined standby state;

an image forming unit to form an image on a sheet; and an operation unit to be operated by a user, wherein, with the backup control, the control unit makes the image forming apparatus shift from the operating state to the standby state, wherein the standby state includes a backup-time standby state to which the image forming apparatus shifts from the operating state with the backup control, and a non-backup-time standby state to which the image forming apparatus shifts from the operating state without the backup control after job execution, and wherein in the backup-time standby state, the control unit makes the memory unit operate and makes the image forming unit and the operation unit stop operating.

2. The image forming apparatus according to claim 1, further comprising:

an image forming unit to form an image on a sheet; and an operation unit to be operated by a user, wherein in the backup-time standby state, the control unit makes the image forming unit stop operating, detects an operation to the operation unit, and executes control according to the detected operation.

3. The image forming apparatus according to claim 2, wherein, the control unit makes the operation unit stop operating when a predetermined standby state shift condition is satisfied in the backup-time standby state.

4. The image forming apparatus according to claim 1, wherein the control unit prevents the image forming apparatus from shifting to the non-backup-time standby state during the backup control.

5. The image forming apparatus according to claim 1, wherein, when the control unit detects a predetermined recovering operation to the operation unit with the operation unit non-operating, the control unit executes control according to an operation to the operation unit.

6. The image forming apparatus according to claim 1, further comprising a plurality of units each of which operates or stops operating depending on a state of the image forming apparatus, wherein the control unit makes the plurality of units stop operating in the standby state, and, when a predetermined recovering condition is satisfied in the standby state, determines whether the backup control is being executed and makes a unit, which corresponds to a determination result, operate again among the plurality of units which are non-operating.

7. The image forming apparatus according to claim 6, wherein the plurality of units include an image forming unit to form an image on a sheet, and when the predetermined recovering condition is satisfied in the standby state, the control unit makes the image forming unit, which is non-operating, operate again under the condition that the control unit determines that the backup control is not being executed.

8. An image forming apparatus comprising:

a memory unit to store various pieces of information;

a plurality of units each of which operates or stops operating depending on a state of the image forming apparatus; and a control unit to execute backup control to store information stored in the memory unit into an external memory device and to make the image forming apparatus shift from an operating state to a predetermined standby state in which the plurality of units are made to stop operating, wherein when a predetermined recovering condition is satisfied in the standby state, the control unit determines whether the backup control is being executed and makes a unit, which corresponds to a determination result, operate again among the plurality of units which are non-operating.

9. The image forming apparatus according to claim 8, wherein the plurality of units include an image forming unit to form an image on a sheet, and when the predetermined recovering condition is satisfied in the standby state, the control unit makes the image forming unit, which is non-operating, operate again under the condition that the control unit determines that the backup control is not being executed.

10. An image forming apparatus comprising:

a memory unit to store various pieces of information;

a plurality of units each of which operates or stops operating depending on a state of the image forming apparatus; and a control unit to execute backup control to store information stored in the memory unit into an external memory device and, when a predetermined standby state shift condition is satisfied, to determine whether the backup control is being executed and to make a unit, which corresponds to a determination result, stop operating among the plurality of units which are operating, wherein, when the standby state shift condition is satisfied, the control unit does not make the memory unit stop operating when determining that the backup control is being executed, and makes the memory unit stop operating when determining that the backup control is not being executed.

11. An image forming apparatus comprising:

a memory unit to store various pieces of information; and a control unit to execute backup control to store information stored in the memory unit into an external memory device and, when a predetermined standby state shift condition is satisfied, to make the image forming apparatus shift to a predetermined standby state in which a unit, which is operating, is made to stop operating, wherein the standby state includes a first standby state in which a unit, except for at least the memory unit, is non-operating, and a second standby state in which a unit including the memory unit is non-operating, wherein, when the standby state shift condition is satisfied to make the image forming apparatus shift to the standby state, the control unit determines whether the backup control is being executed, and, when determining that the backup control is being executed, makes the image forming apparatus shift to the first standby state, and, when determining that the backup control is not being executed, makes the image forming apparatus shift to the second standby state.

* * * * *